US005173394A

United States Patent [19]

Hayashi

[11] Patent Number: 5,173,394

[45] Date of Patent: Dec. 22, 1992

[54] METHOD FOR PROCESSING SILVER HALIDE COLOR PHOTOGRAPHIC MATERIALS

[75] Inventor: Hiroshi Hayashi, Kanagawa, Japan

[73] Assignee: Fuji Photo Film Co., Ltd., Kanagawa, Japan

[21] Appl. No.: 729,750

[22] Filed: Jul. 9, 1991

[30] Foreign Application Priority Data

Jul. 10, 1990 [JP] Japan ..... 2-180528

[51] Int. Cl.[5] ..... G03C 7/40

[52] U.S. Cl. ..... 430/372; 430/393; 430/421; 430/428; 430/430; 430/460; 430/963

[58] Field of Search ..... 430/372, 393, 421, 428, 430/430, 460, 963

[56] References Cited

U.S. PATENT DOCUMENTS 4,681,835 7/1987 Ishikawa et al. ..... 430/372
4,778,748 10/1988 Kuse et al. ..... 430/421
5,063,139 11/1991 Hayashi ..... 430/963

*Primary Examiner*—Hoa Van Le

*Attorney, Agent, or Firm*—Sughrue, Mion, Zinn, Macpeak & Seas

[57] ABSTRACT

A method for continuously processing an imagewise exposed silver halide color photographic material comprising a support having thereon at least one silver halide emulsion layer, comprising the steps of developing with a color developer, bleaching with a processing bath having a bleaching ability comprising a bleaching agent in a concentration of at least 0.15 mol/liter, water washing and/or stabilizing with at least two sequential processing tanks, and drying the thus processed photographic material, wherein the equilibrium iron concentration of the processing solution in the tank immediately preceding the final tank of the water washing and/or stabilizing step is from 100 to 500 ppm and the equilibrium iron concentration is at least seven times that of the processing solution in the final tank of the water washing and/or stabilizing step, and the time from the start of the bleaching step to the completion of the water washing and/or stabilizing step is not more than 65 seconds.

17 Claims, No Drawings

METHOD FOR PROCESSING SILVER HALIDE COLOR PHOTOGRAPHIC MATERIALS

FIELD OF THE INVENTION

The present invention relates to a method of processing a silver halide color photographic material, and more particularly to a novel method of processing for the formation of high quality color prints having excellent ultra-rapid processing characteristics, and especially good rapid processing characteristics from the bleaching process through to the water washing or stabilization process.

BACKGROUND OF THE INVENTION

The well known method of silver salt photography generally comprises forming a colored image by developing exposed silver halide grains with a primary aromatic amine compound as a developing agent, reacting a color coupler with the oxidized form of a developing agent thereby formed, subjecting the material to a bleaching process (bleaching, fixing and/or bleach-fixing), a water washing process and/or a stabilizing process and drying.

There is a need in the art to conduct development processing of a photographic material as rapidly as possible to improve the productivity of the processing house and to shorten the time for which the customer must wait to receive the processed prints.

Increasing the processing temperature and increasing the replenishment rate are generally used as methods of shortening the time of each processing operation, but many other methods such as the use of forced agitation and the addition of various accelerators have also been suggested.

For example, a method in which a color photographic material containing a high silver chloride content emulsion in place of a conventionally employed silver bromide or silver iodide emulsion is processed to speed up color development and/or to reduce the replenishment rate has been disclosed in International Patent(Laid Open) WO 87-04534.

By using high silver chloride content emulsions and development processing baths of this type, the 3 minute 30 second development time for a conventional silver chlorobromide emulsion system (for example, color process CP-20 of the Fuji Photo Film Co., Ltd.) has been shortened to 45 seconds (for example, color process CP-40FAS of the Fuji Photo Film Co., Ltd. total processing time: 4 minutes). However, such shortened processing times are still unsatisfactory when compared with the total processing times achieved in other recording systems (for example, electrostatic copying systems, thermal transfer systems and ink jet systems).

In view of the above, it is clear that the processing time from the bleaching process onwards must be shortened in order to effectively reduce the overall processing time in addition to providing a shortened color development processing time.

Increasing the concentration of bleaching agent in the processing bath and increasing the activity of the processing bath are effective means of achieving adequate bleaching even with short bleaching times. However, as the bleaching agent concentration is increased, it becomes increasingly difficult to remove the bleaching agent from the photosensitive material with the subsequent water washing or stabilizing process. Furthermore, some of the bleaching agent inevitably remains in the photosensitive material.

Moreover, when the processing time is shortened and the subsequent water washing or stabilizing process is also simplified and shortened, the residue of developer components and bleach-fixing components remaining in the photosensitive material, and especially bleaching component residues due to increased bleaching agent concentration, is inevitably much higher than that observed with a water washing or stabilizing process carried out with the longer conventional processing time.

It has long been known that a residue of developing components and bleach-fixing components in the photosensitive material adversely affects the storage properties of a print. Residual color developer reacts with unreacted coupler with the passage of time to result in undesirable staining. Furthermore, if bleaching components remain, the photosensitive material provides an oxidizing environment such that yellow staining occurs, especially under conditions of high temperature and humidity.

The removal of these residual reagents from photosensitive materials has been reported by H. Iwano, T. Ishikawa and M. Yoshizawa at the fifth Photofinishing Technology International Symposium (Chicago, 1986) in a report entitled *The Chemistry of Washing, The Way to Ensure Photoprocessing Quality at Minilabs.* It was found that the selection of an appropriate washing time, wash water temperature and agitation speed is effective for removing developing agents, and that washing with large amounts of water or in a multistage countercurrent system is effective for the removal of ethylenediaminetetraacetic acid, ferric salt widely used as a bleaching agent. It was further found that the difference in the removal rate of residual developer as compared to residual bleaching agent (due to the means of promoting the removal of developing agent and the means of promoting the removal of bleaching agent) is dependent on the extent of the interaction of these components with the binder.

It is known that in the case of rapid processing in particular the storage properties of prints which have been processed continuously are considerably degraded (in terms of increased staining and a lowering of dye density) because of the increase in residual bleaching agent concentration and the shortening of the water washing characteristic of ultra-rapid processing.

There tends to be an improvement with respect to this type of staining when a low pH of the photosensitive material is maintained. However, a low pH results in cyan and yellow color fading under conditions of high temperature and humidity. Techniques for reducing carryover or for decolorizing colored components in the photosensitive material when water washing is inadequate are proposed in JP-A-58-14834, JP-B-61-20864, JP-A-60-263939, JP-A-61-170742, JP-A-58-132743 and JP-A-61-151538 (the terms "JP-A" and "JP-B" as used herein refer to a "published unexamined Japanese patent application" and an "examined Japanese patent publication", respectively.) However, each of these techniques is inadequate for ultra-rapid processing since the water washing or stabilizing time and the amount of water used are very small. Larger amounts of developing components and bleach-fixing components are carried over as compared with conventional washing, and in those cases where continuous processing is carried out with a high bleaching agent concentration in particular, large amounts of colored components are left behind in the photosensitive material. As a result, staining tends to occur in the white portions on storing the finished print under conditions of high temperature and humidity, and fading of the dyes also tends to occur such that the commercial value of the print is reduced.

Moreover, a method in which a high silver chloride content emulsion is processed in a substantially benzyl alcohol free color developer for not more than 25 seconds and, wherein the total processing time, including the said development processing time, the bleach-fixing process time and the water washing process time, is within 2 minutes has been proposed as a technique for shortening the wet bath processing time from development to water washing as described in JP-A-1-196044. However, this technique alone is still inadequate for resolving the problems described above.

SUMMARY OF THE INVENTION

An object of the present invention is to provide an ultra-rapid method for processing a silver halide color photographic material of high quality wherein the finished prints have excellent storage properties under conditions of high temperature and high humidity.

The present inventors have discovered that the above objectives are attained by providing a method for continuously processing an imagewise exposed silver halide color photographic material comprising a support having thereon at least one silver halide emulsion layer, comprising the steps of developing with a color developer, bleaching with a processing bath having a bleaching ability comprising a bleaching agent in a concentration of at least 0.15 mol/liter, water washing and/or stabilizing with at least two sequential processing tanks, and drying the thus processed photographic material, wherein the equilibrium iron concentration of the processing solution in the tank immediately preceding the final tank of the water washing and/or stabilizing step is from 100 to 500 ppm and the equilibrium iron concentration is at least 7 times that of the processing solution in the final tank of the water washing and/or stabilizing step, and the time from the start of the bleaching step to the completion of the water washing and/or stabilizing step is not more than 65 seconds.

DETAILED DESCRIPTION OF THE INVENTION

As described above, as the processing time for the bleaching and subsequent processes is shortened, the bleaching agent concentration is desirably increased in order to obtain an adequate bleaching effect with a shortened bleaching or bleach-fixing time. However, the use of a high bleaching agent concentration in the bleaching bath or bleach-fixing bath is undesirable from the point of view of shortening the water washing and/or stabilizing time while still adequately washing out the bleaching agent components (especially with low replenishment rates and shortened processing times), to thereby provide satisfactory image storage properties. The concentration of the bleaching agent is therefore conventionally selected (for example, at from 0.10 to 0.135 mol/liter) in consideration of the balance between these two factors.

On the other hand, in the present invention, the concentration of bleaching agent in the processing bath having a bleaching ability and the equilibrium iron concentration in the processing solutions of the final bath and penultimate bath in the water washing or stabilizing process are each selected as described above to obtain satisfactory photographic performance (especially with respect to prevention of staining) even with ultra-short processing times from the start of the bleaching process to the water washing or stabilization process of not more than 65 seconds.

The process having a bleaching ability may be a bleaching process or a bleach-fixing process, and the bleaching process operations (i.e., the bleaching process steps) which can be used in the present invention are in general a bleaching - fixing operation, a fixing-bleach-fixing operation, a bleaching - bleach-fixing operation, or a bleach-fixing operation.

A characteristic feature of the present invention is that the bleaching agent concentration in at least one processing bath having a bleaching ability is at least 0.15 mol/liter, and the bleaching agent concentration is preferably from 0.16 to 0.27 mol/liter, and more preferably from 0.17 to 0.24 mol/liter.

Organic complex salts of iron(III) (for example, complex salts of aminopolycarboxylic acids, such as ethylenediaminetetraacetic acid, diethylenetriaminepentaacetic acid; aminopolyphosphonic acids; phosphonocarboxylic acids and organopolyphosphonic acids), are especially desirable as the bleaching agent for use in the processing solution having a bleaching ability (bleaching or bleach-fixing solution) in an amount of at least 0.15 mol/liter. Examples of aminopolycarboxylic acids, aminopolyphosphonic acids, organophosphonic acids and salts thereof which are useful for forming organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid. These compounds may take the form of sodium, potassium, lithium or ammonium salts. Among these compounds, the iron(III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are preferred in view of their high bleaching power. The ferric ion complex salts can be used in the form of a complex salt, or the ferric ion complex salt may be formed in solution using ferric sulfate, ferric chloride, ferric nitrate, ferric ammonium sulfate or ferric phosphate, for example, and a chelating agent such as an aminopolycarboxylic acid, an aminopolyphosphonic acid or a phosphonocarboxylic acid. Furthermore, the chelating agent may be used in excess of that required to form the ferric ion complex salt. The aminopolycarboxylic acid iron complex salts are preferred among these complex salts.

Moreover, a second characteristic feature of the present invention is that the iron concentration in the processing solution at equilibrium in the continuous processing (the equilibrium iron concentration) in the tank immediately preceding the final tank in the water washing or stabilization process (for example, the first tank in the case of a two-tank water washing/stabilizing assembly, the second tank in the case of a three tank assembly or the third tank in the case of a four tank assembly) is from 100 to 500 ppm, and preferably from 100 to 300 ppm, and the equilibrium iron concentration in the processing solution in the tank immediately preceding the final tank is at least 7 times, and preferably at least 9 times, the equilibrium concentration of the processing solution in the final tank.

The process comprising water washing and/or stabilization in the final tank which can be used in the present invention comprises not less than two tanks. For example, when the final tank is for only water washing, the water washing tank comprises not less than two tanks, when the final tank is for only stabilization, the stabilization tank comprises not less than two tanks.

In particular, the water washing water or stabilizer in the final tank can be treated with a reverse osmosis membrane, for example, or a chelate exchange resin and/or an ion exchange resin can be used to set the equilibrium iron concentration in the processing solution in the tank immediately preceding the final tank to at least 7 times that in the final tank.

Useful commercial chelate exchange resins include, for example, Uniseleck UR-10, 20, 30, 40, 50, 3200, 3500, 3900 (made by the Unichika Co.) and Daiyaion CRB-02, CR20, 40, 50 (made by the Mitsubishi Kasei Co.). Among these resins, UR20, 3900 and CRB-02 are preferred.

Moreover, Amberlite IRA-116, 122, IRC-84, ZRA-400 (made by Rohm and Haas Co.) can be used as the ion exchange resins. Of these, IRA-116 and ZRA-400 are especially desirable.

These processes may be carried out using a number of exchange resins in order to increase the processing rate and to establish the equilibrium iron concentration of the bath immediately preceding the final tank with a factor of at least 7 times that of the final tank, the solution being passed through an exchange resin in a process comprised of two or more stages.

In the present invention, treatment of the water washing water and/or stabilizing process water using a reverse osmosis membrane is especially desirable. Here, treatment of the washing water and/or stabilizing process water with a reverse osmosis membrane includes a technique where the water in the tank which is next to the last tank in the water washing and/or stabilization process operation is brought into contact with a reverse osmosis membrane. The water which passes through the reverse osmosis membrane (referred to hereinafter as the permeated water) is returned to the final tank in the water washing or stabilization processing operation (step).

Furthermore, techniques in which washing water and/or stabilizing process solutions are subjected to a reverse osmosis treatment are known as techniques for preventing the occurrence of staining as disclosed, for example, in JP-A-60-241053 and JP-A-62-254151. It is considered that the unwanted components (especially the fixing and bleach-fixing components) in the water washing water and stabilizer (i.e., stabilizing solution) are removed by subjecting the processing solution to reverse osmosis, and that this treatment reduces the extent of the adverse effect on the photosensitive material.

However, in the case of processing in which the processing time from bleaching through to water washing and/or stabilization is shortened considerably, it is not possible to achieve satisfactory photographic performance using the above described reverse osmosis technique alone. Particularly, desilvering failure and staining of the white base may occur, and these problems are not resolved satisfactorily.

Moreover, the treatment of washing water and/or stabilizing process water using a reverse osmosis membrane in a rapid processing system has been disclosed in Japanese Patent Application 2-8495, but the correspondence of the bleaching process to rapid processing and investigation of the removal efficiency with the membrane, for example, have not been adequate. Furthermore, there is still a problem with reduction of the processing time from the bleaching process operation and subsequent processing steps.

Cellulose acetate, crosslinked polyamide, polyether, polysulfone, poly(acrylic acid) or poly(vinyl carbonate), for example, can be used as materials for the reverse osmosis membrane, but crosslinked polyamide based composite membranes and polysulfone based composite membranes are especially desirable with respect to reduction in the amount passed of permeated water which tends to occur.

The use of low pressure reverse osmosis membranes which can be used at a low liquid back pressure of 2 to 15 kg/cm$^2$ is preferred for reduced initial cost and running cost of the apparatus, miniaturization and the prevention of pump noise, etc. Moreover, the membrane structure may take the form of a flat membrane which is wound into a spiral, which spiral form is preferred for minimizing the reduction in the amount passed of permeated water. Useful examples of low pressure reverse osmosis membranes of this type include the SU-200S, SU-210S and SU-220S membranes made by the Toray Co. and the DRA-40, DRA-80 and DRA-86 membranes made by the Daisel Chemical Co.

The reverse liquid pressure which is used with these membranes is within the range as described above, but pressures of from 2 to 10 kg/cm$^2$, and most desirably of from 3 to 7 kg/cm$^2$, are preferred for preventing the occurrence of residual coloration and limiting reduction in the amount of permeated water.

The water washing operation is carried out in from two to six tanks, but a multistage countercurrent system with a plurality of tanks connected together is preferred for the above described photographic processing in order to provide increased water economy, and the use of three or four tanks is especially desirable.

Treatment with a reverse osmosis membrane is preferably carried out with the water from the second and subsequent tanks in such a multistage countercurrent water washing system. In practice, with a two tank system the water in the second tank is treated with a reverse osmosis membrane, in the case of a three tank system the water from the second or third tank is treated with a reverse osmosis membrane and in the case of a four tank system the water from the third or fourth tank is treated with a reverse osmosis membrane. The permeated water is returned to the same tank (the tank from which the water for reverse osmosis membrane treatment was collected, referred to hereinafter as the collection tank), or the water washing tank located subsequent to this tank. Furthermore, the concentrated solution which is generated by treatment with a reverse osmosis membrane is supplied to the tank which is located preceding of the tank to which the permeated water is returned (referred to hereinafter as the supply tank).

The required amount of permeated water supply is determined by the quality of the permeated water (the removal performance of the reverse osmosis membrane), the amount of photosensitive material being processed in the automatic processor, the carry-over of solution from the preceding tank by the photosensitive material and the amount of fresh water which is being supplied, and this amount is generally within the range from 1 to 100 times the amount of fresh water which is being supplied. In those cases where the amount of water being supplied is low (where the replenishment rate is low), the amount of the permeated water supply is preferably from 5 to 55 times, and most desirably from 10 to 30 times, the amount of fresh water which is being supplied.

A system for use in the present invention by which treatment is carried out using a reverse osmosis membrane is described in detail below.

For example, in a system having a three tank counter-current water washing system, water washing water is collected from the second water washing tank and treated with a reverse osmosis membrane, the permeated water is supplied to the third water washing tank and the concentrated solution is returned to the second water washing tank. This method requires a simple pipe work system and has a further advantage in that it can be carried out at low cost. The pressure resistant vessel is made of metal or plastic and the reverse osmosis membrane is housed within this vessel. A glass fiber reinforced plastic is preferred for the wall material of the pressure resistant vessel with respect to corrosion resistance and pressure resistance. Use of a method in which such a reverse osmosis membrane is employed is also desirable in cases where there are four or more tanks. Furthermore, the amount of fresh water replenishment required is greatly reduced by the reverse osmosis membrane treatment. The amount of overflow from the first water washing tank is reduced in proportion, and all of the overflow can be introduced into the bleach-fixing tank.

Furthermore, methods in which the water collected from the third water washing tank is introduced into a stock tank and the water from the stock tank is treated with a reverse osmosis membrane with the permeated water being supplied to the third water washing tank and the concentrated solution being returned to the stock tank can also be used.

All of the overflow from the third water washing tank which arises as a result of the replenishment with fresh water can be introduced into the stock tank, and water washing water is supplied by means of a pump from the stock tank to the second water washing tank. The pump operation can be controlled by providing a float switch inside the stock tank. By using a stock tank in this way the water in the final washing tank can be treated with the reverse osmosis membrane. As a result, water which has a lower concentration than in the circumstances described above is treated, such that the permeated water is even of higher purity and the final water washing water is maintained in a purer condition.

However, the additionally required apparatus such as the stock tank is a complication. Thus, either of the two methods described above can be selected appropriately in view of the desired effectiveness as balanced by the increased cost.

A method wherein a stock tank is used can also be used effectively in cases where there are two tanks or where there are four or more tanks.

In the present invention, the fresh water which is supplied to the water washing tank is generally town water or well water, for example, which can be used for water washing purposes. However, water in which the calcium and magnesium concentrations have both been reduced to not more than 3 mg/liter is desirable for preventing the growth of bacteria in the supply tank and prolonging the life of the reverse osmosis membrane. In practice, the use of water which has been deionized with an ion exchange resin or by distillation is preferred.

The addition of biocides, chelating agents, pH buffers and fluorescent brightening agents, for example, to the washing water is well known, and these additives can be used in the present invention, if desired. A large amount of additives should not be used so as not to increase the load on the reverse osmosis membrane. Namely, the present invention has the advantage of providing satisfactory economy with respect to water usage without using the biocides etc. which have been conventionally required.

Moreover, in cases where bacteria grow in the storage tank in which the fresh water for supply purposes is stored, the storage tank is preferably irradiated with ultraviolet light.

A third characteristic feature of the present invention is that the time from the start of the process having a bleaching ability (the first process having a bleaching ability in cases where there are two or more processes having a bleaching ability) up to the completion of processing in the final water washing and/or stabilization bath is not more than 65 seconds, and preferably not more than 55 seconds. Here, the term "up to the completion of processing in the final bath" signifies the time until the photosensitive material emerges from the final tank and does not include the time for which the material is exposed in the air after leaving the final tank and before drying.

Satisfactorily good photographic performance can be obtained even though the processing time has been shortened in this way.

Moreover, on investigating the shortening of the overall processing operation from color development to drying in a method for processing a silver halide photographic material comprising a silver halide emulsion containing at least 90 mol% silver chloride, the present applicants found that the alkali consumption of such a photographic material is not more than 3.0 mmol/$m^2$. Furthermore, the present applicants discovered that the time from the start of the color development operation to the completion of drying is not more than 100 seconds in the above described embodiment of the present invention.

Namely, by specifying the photosensitive material as described above, satisfactory photographic performance can be obtained even when the above described processing operation is shortened to not more than 100 seconds. The overall processing operation time is preferably not more than 90 seconds.

Here, the color development time, the bleaching, fixing and/or bleach-fixing time and the water washing and/or stabilization process time is the time from the point at which the photosensitive material makes contact with each processing solution until the material makes contact with the next processing solution, which time includes the time spent standing in air.

In the present invention, the "alkali consumption" of the photosensitive material is that obtained by measurement and calculation using the method of measurement described below.

The "alkali consumption" is first determined taking a sample of fixed area (in practice 1 $m^2$) of the photosensitive material of the present invention and peeling the coated layer off from the support. The support generally consists of a polyethylene laminated paper and the peeling is achieved at the laminated polyethylene layer. Next, the coated layer is finely ground and then dispersed in a fixed quantity of water (in practice, in 100 ml of water). Next, this solution is titrated with an aqueous alkaline solution (in practice, with 0.1 N aqueous sodium hydroxide solution) and the amount of sodium hydroxide, in units of mmol, required to change the pH of the solution from 6.0 to 10.0 is defined as the "alkali consumption".

Acid components are included in the support but, in those cases where separation from the support is impossible, the evaluation can be made by subtracting the measured value for the support alone.

The alkali consumption is an evaluation of the acid component contained in the photosensitive material and its pH buffering ability, and in practice is affected by the gelatin which is used as a hydrophilic binder and the other organic compounds in the photosensitive material.

In the present invention, initial development is retarded if the alkali consumption is high because a high alkalinity cannot be maintained in the initial stages of the development. As a result, it is not possible to shorten the development processing time. High alkali consumption is also considered to have an effect on the occurrence of staining in cases where the water washing time is shortened and overall ultra-rapid processing is carried out, and the unexpected results are achieved by combination with a reverse osmosis membrane.

The methods indicated below are preferred for reducing the "alkali consumption" of the photosensitive material in accordance with the present invention.

First, the amount of hydrophilic colloid having an acidic group in the sensitive material layers can be reduced.

The use of gelatin as the hydrophilic colloid of a color photographic material in which a silver halide emulsion is used as the photosensor is most desirable. However, gelatin has a pH buffering ability on immersion in an alkaline solution due to the functional groups contained therein.

The lowering of this buffering ability is important for speeding up the initial development in rapid processing, and methods in which the amount of gelatin is reduced are desirable.

Second, it is possible that the physical properties of the film will be adversely affected by simply reducing the amount of gelatin alone such that a hydrophilic polymer which does not have an acidic functional group can be used together with gelatin.

The exemplary hydrophilic polymers provided below can be used in the present invention, but the use of polyacrylamide, polydextran and poly(vinyl alcohol), for example, is especially desirable.

Third, the type of gelatin which is used for the hydrophilic colloid can be modified.

In practical terms, the alkali consumption can be suppressed by using a gelatin prepared by changing the method of treatment during manufacture thereof, or which has been esterified or converted to an amide to reduce the number of acidic groups contained in the gelatin such that the number of functional groups and the isoelectric point are advantageously modified.

Fourth, the amount of the organic material other than gelatin (couplers, and hydroquinone and phenolic compounds, for example) contained in the photosensitive material can be reduced. If a film hardening agent is used in conjunction with these means, a photosensitive material is obtained having a more rapid initial swelling rate.

Fifth, the alkali consumption can be reduced by adjusting the pKa value of the above noted organic compounds.

The "alkali consumption" of a photosensitive material in accordance with the present invention is preferably suppressed employing one or more of the techniques described above. The alkali consumption is not more than 3.0 mmol/m$^2$, but is preferably not more than 2.8 mmol/m$^2$, more preferably not more than 2.6 mmol/m$^2$, and most desirably not more than 1.9 mmol/m$^2$.

A color photographic material for use in the present invention can be prepared by coating onto a support at least one blue sensitive silver halide emulsion layer, at least one green sensitive silver halide emulsion layer and at least one red sensitive silver halide emulsion layer. In general, the layers are arranged in the order indicated above on the support in the case of a color printing paper, but the layers may be arranged in a different order.

The image forming system including the photosensitive material and the processing for use in the present invention is generally applicable to rapid processing of color prints, but can also be used in applications such as intelligent color hard copy where increased processing speed is even more desirable.

In particular, embodiments in which the photosensitive material has been subjected to a scanning exposure with a high density light source such as a laser (for example, a semiconductor laser) or a light emitting diode, for example, are especially desirable as embodiments of intelligent color hard copy.

Many semiconductor lasers have high photosensitivity in the infrared region such that the photosensitive material for use in the present invention may have at least one of the above noted emulsion layers replaced by an infrared sensitive silver halide emulsion layer. Color reproduction with the subtractive method can be achieved by including silver halide emulsions which are sensitive to the respective wavelength regions and color couplers which form dyes which are complimentary to the color of the incident actinic light, namely, yellow dyes for the blue, magenta dyes for the green and cyan dyes for the red sensitive emulsion layers. However, the structure of the material may be such that the colors and hues of the photosensitive layer and the coupler do not have the relationship indicated above.

Moreover, depending on the image quality and product quality required, as few as two color couplers can be used. In this case, a silver halide emulsion layer may comprise two layers, one corresponding to each color. In this case the image obtained is not a full color image but is formed more rapidly.

The use of substantially silver iodide free silver chlorobromide or silver chloride is preferred for the silver halide emulsion for use in the present invention. Here, the term "substantially silver iodide free" means that the silver iodide content is not more than 1 mol%, and preferably not more than 0.2 mol%. The halogen composition of the emulsion may differ from grain to grain or may be uniform, but it is easy to obtain the uniform nature of the grains when emulsions having a uniform halogen composition from grain to grain are used. Furthermore, the silver halide composition distribution within the silver halide emulsion grains may be uniform throughout the grain, grains having a layer type structure in which the halogen composition in the core which forms the interior of the silver halide grain and in the surrounding shell part of the grain (the shell may be a single layer or a plurality of layers) is different, or grains having a structure comprising parts having a different halogen composition in a non-layer like form within the grain or on the surfaces of the grain (structures such that parts having a different halogen composition are joined onto the edges, corners or surfaces of the grains where the parts which have a different composition are at the surface of the grains) are appropriately selected for use. The use of grains of either of the latter two types is preferable to the use of grains having a uniform structure for obtaining a high photographic speed, and these grains are also preferred for providing pressure resistance properties. In those cases where the silver halide grains have a structure such as those indicated above, the boundary region between the parts having a different halogen composition may be a distinct boundary or may comprise an indistinct boundary where mixed crystals are formed by the difference in composition, or which boundary may be such that there is a positive and continuous change in structure.

Silver chlorobromides with any silver bromide/silver chloride ratio can be used. A wide range of composition ratios can be accommodated, depending on the intended purpose of the photosensitive material, but the use of emulsions having a silver chloride content of at least 2 mol% is preferred.

Furthermore, the use of high silver chloride emulsions having a high silver chloride content is preferred in a photosensitive material well adapted to rapid processing. The silver chloride content of these high silver chloride emulsions is preferably at least 90 mol%, and most desirably at least 95 mol%.

Structures in which the grains constituting the high silver chloride emulsions have a silver bromide local phase in the form of a layer as described above or in a form other than a layer within the silver halide grains and/or at the grain surface are preferred. The halogen composition of the above described local phase preferably has a silver bromide content of at least 10 mol%, and most desirably has a silver bromide content in excess of 20 mol%. These localized layers can be within the grain or at the edges or corners of the grain surface or on the surfaces of the grain, and in a preferred embodiment the phase is grown epitaxially on the corners of the grains.

On the other hand, the use of grains having a uniform structure with a small halogen composition distribution within the grains is preferred even with high silver chloride emulsions having a silver chloride content of at least 90 mol% for suppressing the loss of photographic speed which arises when pressure is applied to the photosensitive material.

Furthermore, raising the silver chloride content in the silver halide emulsion is also effective for reducing the replenishment rate of the development processing solution. In such a case the use of virtually pure silver chloride emulsions having a silver chloride content of from 98 to 100 mol% is preferred.

The average grain size of the silver halide grains constituting the silver halide emulsion for use in the present invention is preferably from 0.1 to 2 $\mu$m (the average grain size is the numerical average of the grain size taken as the diameter of a circle of area equal to the projected area of the grain).

Furthermore, the grain size distribution is preferably monodisperse having a variation coefficient (the value obtained by dividing the standard deviation of the grain size distribution by the average grain size) of not more than 20%, and most desirably not more than 15%. The use of blends of the above described monodisperse in the same layer, or the lamination coating of monodisperse emulsions is desirable for obtaining a wide latitude.

The silver halide grains constituting the photographic emulsion for use in the present invention may have a regular crystalline form such as a cubic, tetradecahedral or octahedral form, an irregular crystalline form such as a spherical or tabular form, or a complex form which is a composite of such crystalline forms. Furthermore, mixtures of grains which have various crystalline forms can be used. Emulsions in which at least 50%, preferably at least 70%, and most desirably at least 90%, of the grains have a regular crystalline form as indicated above are preferred in the present invention.

Furthermore, the use of emulsions in which tabular grains having an average aspect ratio (diameter of the calculated circle/thickness) of generally at least 5, and preferably of at least 8, generally account for more than 50% of all the grains in terms of projected area is also preferable.

The silver chlorobromide emulsions for use in the present invention can be prepared using the methods disclosed, for example, by P. Glafkides in *Chimie et Physique Photographique*, published by Paul Montel, 1967, by G. F. Duffin in *Photographic Emulsion Chemistry*, published by Focal Press, 1966, and by V. L. Zelikman et al. in *Making and coating Photographic Emulsions*, published by Focal Press, 1964. Particularly, the emulsions can be prepared using an acidic method, a neutral method and an ammonia method, for example, and a single jet method, a double jet method, or a combination of such methods, can be used for reacting the soluble silver salt with the soluble halogen salt. Methods in which the grains are formed in the presence of an excess of silver ion (e.g., a reverse mixing method) can also be used. The method in which the pAg value in the liquid phase in which the silver halide is being formed is held constant, namely, the controlled double jet method, can be also used as a type of double jet method. It is possible to obtain regular silver halide emulsions with an almost uniform grain size when this method is used.

Various multivalent metal ion impurities can be introduced into the silver halide emulsion for use in the present invention during the formation or physical ripening of the emulsion grains. For example, salts of cadmium, zinc, lead, copper or thallium, or salts or complex salts of metals of group VIII of the Periodic Table, such as iron, ruthenium, rhodium, palladium, osmium, iridium and platinum, for example, can be used as compounds of this type. The use of the above described group VIII elements is especially desirable. The amount of these compounds added varies over a wide range depending on the intended purpose, but an amount of from $1\times10^{-9}$ to $1\times10^{-2}$ mol per mol of silver halide is generally desirable.

The silver halide emulsion for use in the present invention is generally subjected to chemical sensitization and spectral sensitization.

Sulfur sensitization as typified by the addition of unstable sulfur compounds, noble metal sensitization as typified by gold sensitization, or reduction sensitization, for example, can be used alone or in combination for the purpose of chemical sensitization. Use of the compounds disclosed from the lower right hand column on page 18 to the upper right hand column on page 22 of the specification of JP-A-62-215272 for chemical sensitization is preferred.

Spectral sensitization is carried out in order to sensitize each emulsion layer in a photosensitive material of the present invention to light of a prescribed wavelength region. In the present invention, spectral sensitization is preferably achieved using spectral sensitizing dyes, namely, dyes which absorb light in the wavelength region corresponding to the target spectral sensitivity. Examples of useful spectral sensitizing dyes are disclosed, for example, by F. M. Harmer in *Heterocyclic Compounds, Cyanine Dyes and Related Compounds*, (John Wiley & Sons (New York, London), 1964). Examples of actual preferred compounds for use in the present invention are disclosed from the upper right hand column on page 22 to page 38 of the specification of the above noted JP-A-62-215272.

Various compounds or precursors thereof can be added to the silver halide emulsion for use in the present invention to prevent the occurrence of fogging during the manufacture, storage or photographic processing of the photosensitive material, or for stabilizing photographic performance. Useful examples of such compounds are disclosed on pages 39 to 72 of the specification of the above noted JP-A-62-215272, and the use of these compounds is desirable.

The emulsion for use in the present invention may be either a surface latent image type in which the latent image is formed principally on the grain surfaces, or an internal latent image type in which the latent image is formed principally within the grains.

In those cases where the present invention is applied to a color photosensitive material, yellow couplers, magenta couplers and cyan couplers which form yellow, magenta and cyan colors, respectively, on coupling with the oxidant of a primary aromatic amine based color developing agent are generally used in the color photosensitive material.

Use of the cyan couplers, magenta couplers and yellow couplers represented by the formulae (C-I), (C-II), (M-I), (M-II) and (Y) indicated below is preferred in the present invention.

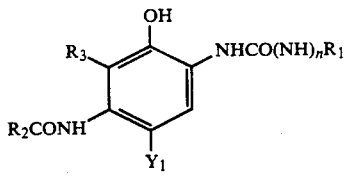

(C-I)

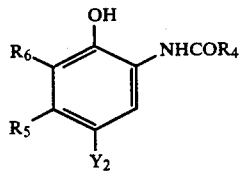

(C-II)

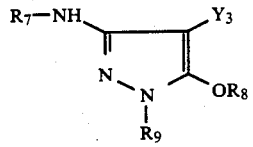

(M-I)

-continued

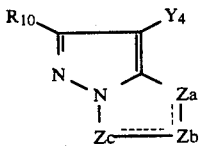

(M-II)

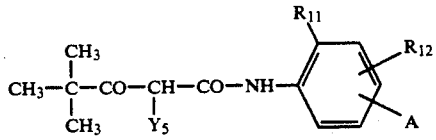

(Y)

In formulae (C-I) and (C-II), $R_1$, $R_2$ and $R_4$ each represents a substituted or unsubstituted aliphatic, aromatic, or heterocyclic group, $R_3$, $R_5$ and $R_6$ each represents a hydrogen atom, a halogen atom, an aliphatic group, an aromatic group or an acylamino group, and $R_3$ may represent a group of nonmetal atoms which, together with $R_2$, forms a 5- or 6-membered nitrogen-containing ring. $Y_1$ and $Y_2$ each represents a hydrogen atom or a group which is released during a coupling reaction with the oxidant of a primary aromatic amine developing agent, and n represents 0 or 1.

$R_5$ in formula (C-II) preferably represents an aliphatic group, for example, a methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl group.

Preferred examples of the cyan couplers represented by the formulae (C-I) and (C-II) are described below.

$R_1$ in formula (C-I) preferably represents an aryl group or a heterocyclic group, and an aryl group substituted with a substituent selected from a halogen atom, an alkyl group, an alkoxy group, an aryloxy group, an acylamino group, an acyl group, a carbamoyl group, a sulfonamide group, a sulfamoyl group, a sulfonyl group, a sulfamide group, an oxycarbonyl group and a cyano group is most desirable.

In those cases where $R_3$ and $R_2$ do not form a ring in formula (C-I), R2 preferably represents a substituted or unsubstituted alkyl group or aryl group, and most desirably a substituted aryloxy substituted alkyl group, and $R_3$ is preferably a hydrogen atom.

$R_4$ in formula (C-II) preferably represents a substituted or unsubstituted alkyl group or aryl group, and most desirably a substituted aryloxy substituted alkyl group.

$R_5$ in formula (C-II) preferably represents an alkyl group having from 2 to 15 carbon atoms or a methyl group having a substituent group having at least 1 carbon atom, and preferred substituent groups include an arylthio group, an alkylthio group, an acylamino group, an aryloxy group and an alkyloxy group.

$R_5$ in formula (C-II) most desirably represents an alkyl group having from 2 to 15 carbon atoms, and an alkyl group having from 2 to 4 carbon atoms is especially desirable.

$R_6$ in formula (C-II) preferably represents a hydrogen atom or a halogen atom, and most desirably a chlorine atom or a fluorine atom. $Y_1$ and $Y_2$ in formulae (C-I) and (C-II) each preferably represents a hydrogen atom, a halogen atom, an alkoxy group, an aryloxy group, an acyloxy group or a sulfonamide group.

In formula (M-I), $R_7$ and $R_9$ each represents an aryl group, $R_8$ represents a hydrogen atom, an aliphatic or aromatic acyl group, or an aliphatic or aromatic sulfonyl group, and $Y_3$ represents a hydrogen atom or a releasing group. The substituent groups for the aryl groups (preferably phenyl groups) represented by $R_7$ and $R_9$ are the same as the substituent groups for $R_1$. In those cases where there are two or more substituent groups these may be the same or different. $R_8$ represents preferably a hydrogen atom, an aliphatic acyl group or sulfonyl group, and most desirably is a hydrogen atom. $Y_3$ represents preferably a group of the type which is released at a sulfur, oxygen or nitrogen atom, and most desirably represents a sulfur atom releasing group of the type disclosed, for example, in U.S. Pat. No. 4,351,897 or International Patent WO 88/04795.

In formula (M-II), $R_{10}$ represents a hydrogen atom or a substituent group. $Y_4$ represents a hydrogen atom or a releasing group, and preferably represents a halogen atom or an arylthio group, Za, Zb and Zc each represents a methine group, substituted methine group, =N—or —NH—, and one of the bonds Za-Zb or Zb-Zc is a double bond and the other is a single bond. The cases where the Zb—Zc bond is a carbon-carbon double bond include those in which this bond is part of an aromatic ring. A dimer or larger oligomer may be formed via $R_{10}$ or $Y_4$, and cases in which, when Za, Zb or Zc is a substituted methine group, a dimer or larger oligomer is formed via a substituted methine group, are included.

Among the pyrazoloazole based couplers represented by formula (M-II), the imidazo[1,2-b]pyrazoles disclosed in U.S. Pat. No. 4,500,630 are preferred from the point of view of its slight absorbance on the yellow side and the light fastness of the colored dye, and the pyrazolo[1,5-b][1,2,4]triazole disclosed in U.S. Pat. No. 4,540,654 is especially desirable.

The use of the pyrazolotriazole couplers in which a branched alkyl group is bonded directly to the 2-, 3- or 6-position of the pyrazolotriazole ring as disclosed in JP-A-61-65245, the pyrazoloazole couplers having a sulfonamide group within the molecule as disclosed in JP-A-61-65246, the pyrazoloazole couplers which have an alkoxyphenylsulfonamide ballast group as disclosed in JP-A-61-147254, and the pyrazolotriazole couplers which have an alkoxy group or an aryloxy group in the 6-position as disclosed in European Patents (Laid Open) 226,849 and 294,785 is also desirable.

In formula (Y), $R_{11}$ represents a halogen atom, an alkoxy group, a trifluoromethyl group or an aryl group, and $R_{12}$ represents a hydrogen atom, a halogen atom or an alkoxy group. A represents —$NHCOR_{13}$, —$NHSO_2$—$R_{13}$, —$SO_2NHR_{13}$, —$COOR_{13}$ or $$-SO_2\underset{\underset{R_{14}}{|}}{N}-R_{13},$$

where $R_{13}$ and $R_{14}$ each represents an alkyl group, an aryl group or an acyl group. $Y^5$ represents a releasing group. The substituent groups for $R_{12}$ and for $R_{13}$ and $R_{14}$ are the same as the substituent groups defined for $R_1$, and the releasing group $Y_5$ represents preferably a group of the type at which elimination occurs at an oxygen atom or a nitrogen atom, and is most desirably a group of the nitrogen atom elimination type.

Useful examples of couplers represented by formulae (C-I), (C-II), (M-I), (M-II) and (Y) are indicated below.

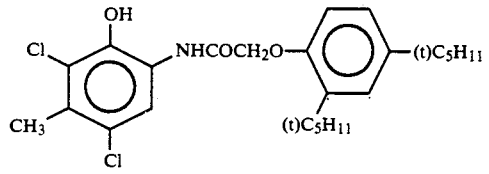

(C-1)

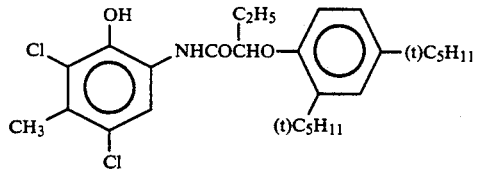

(C-2)

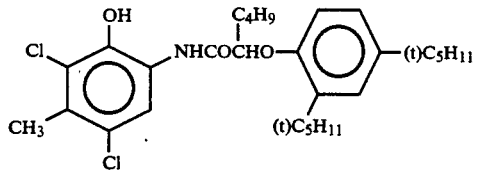

(C-3)

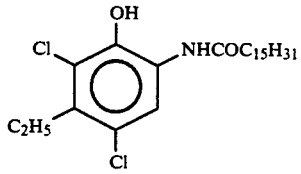

(C-4)

-continued
(C-5)
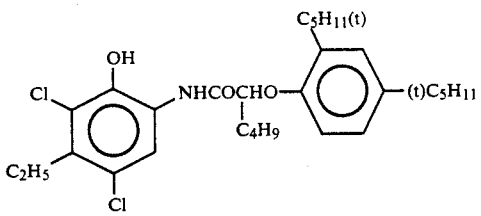
(C-6)
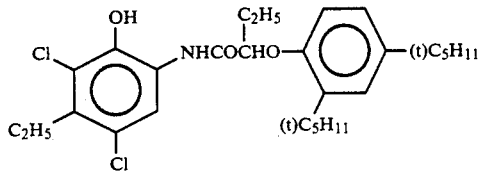
(C-7)
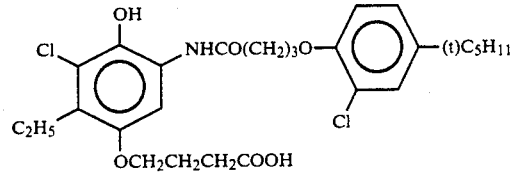
(C-8)
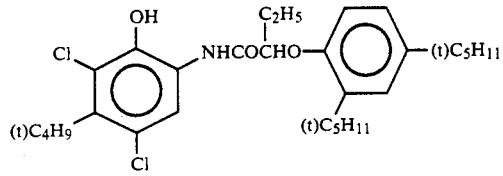
(C-9)
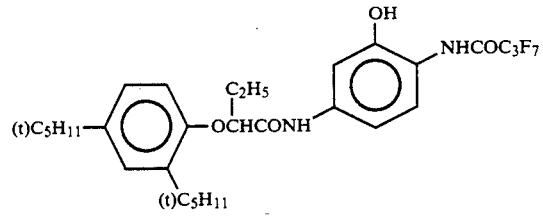
(C-10)
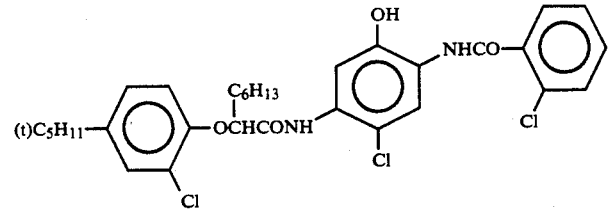
(C-11)
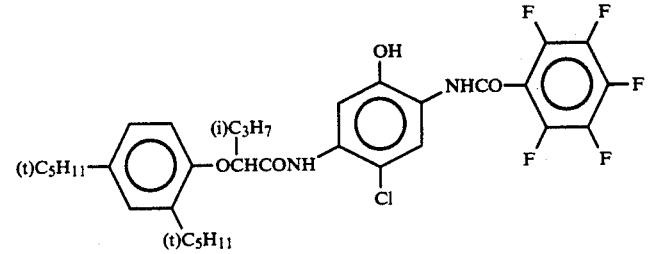

-continued
(C-12)
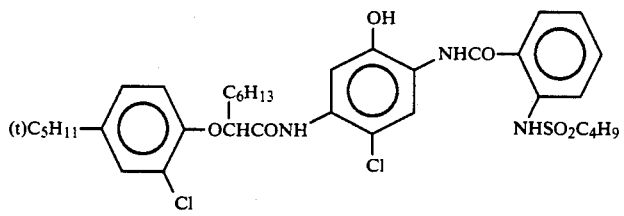
(C-13)
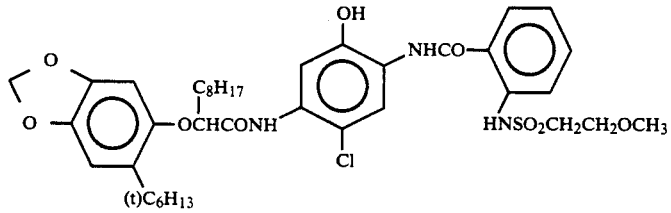
(C-14)
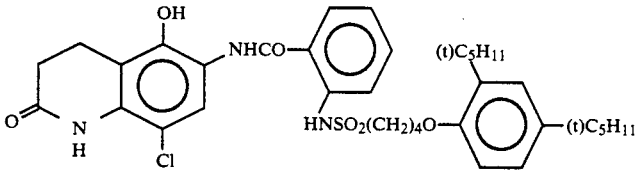
(C-15)
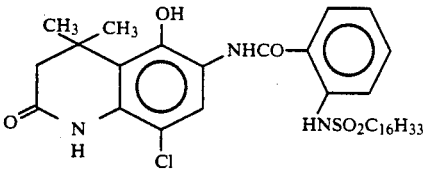
(C-16)
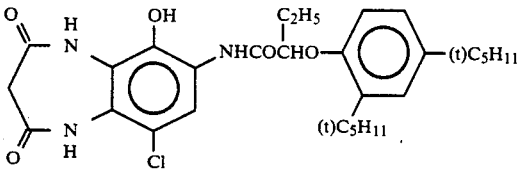
(C-17)
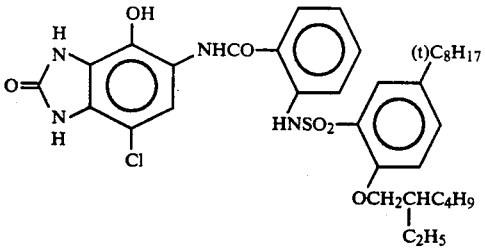
(C-18)
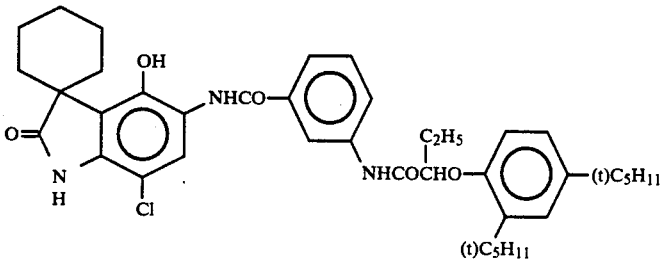

-continued
(C-19)
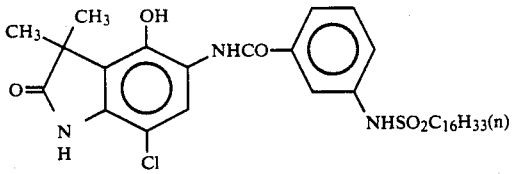
(C-20)
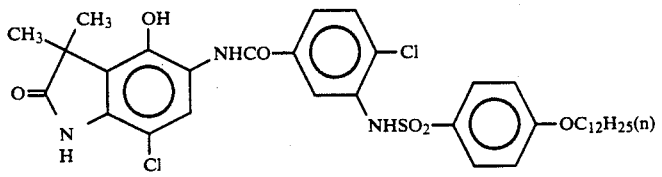
(C-21)
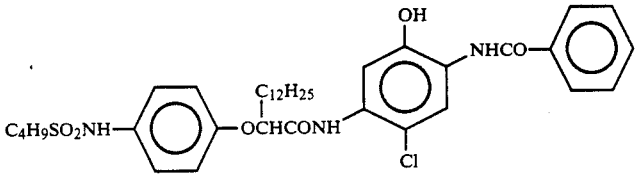
(C-22)
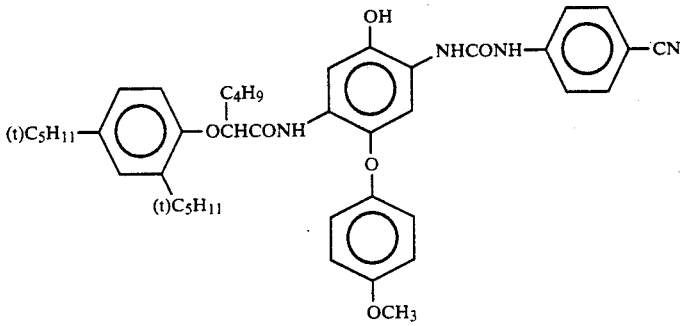
(M-1)
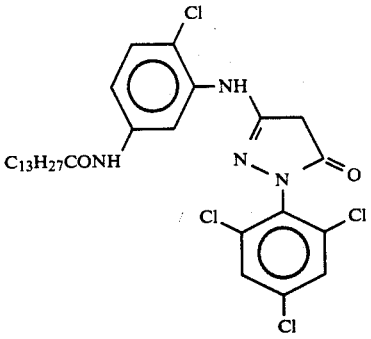
(M-2)
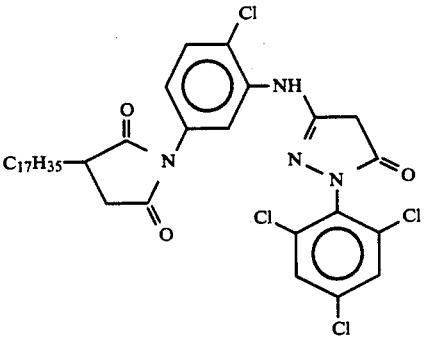

-continued
(M-3)
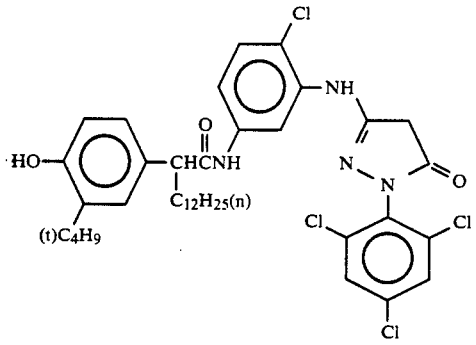
(M-4)
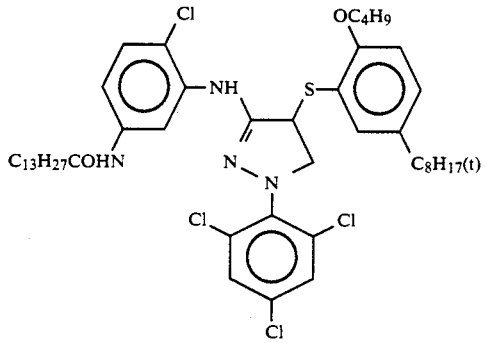
(M-5)
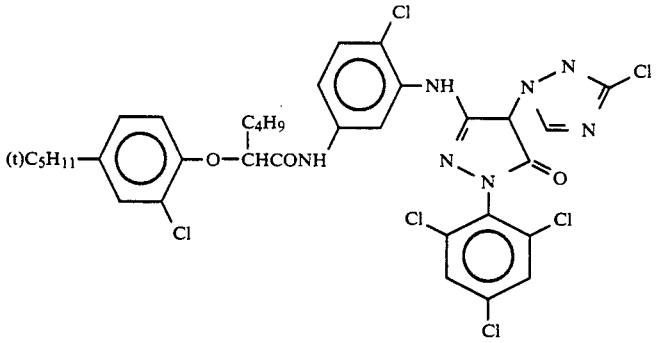
(M-6)
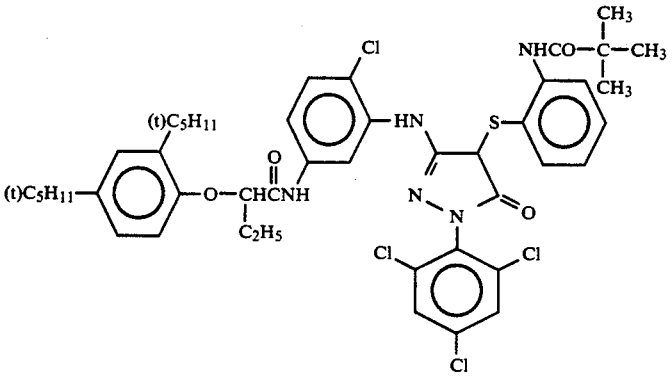

-continued
(M-7)
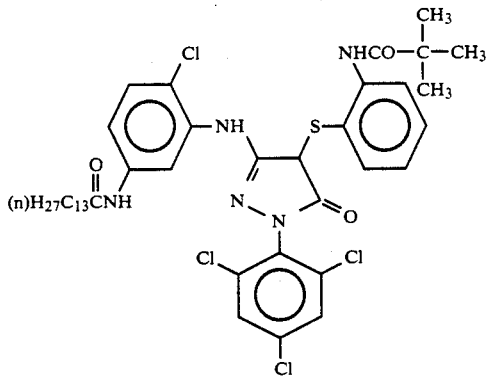
(M-8)
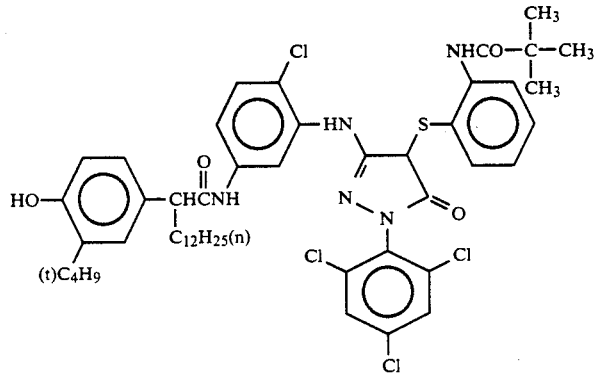

| Compound | $R_{10}$ | $R_{15}$ | $Y_4$ |
|---|---|---|---|
| | | 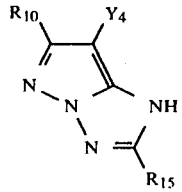 | |
| M-9 | $CH_3$— | 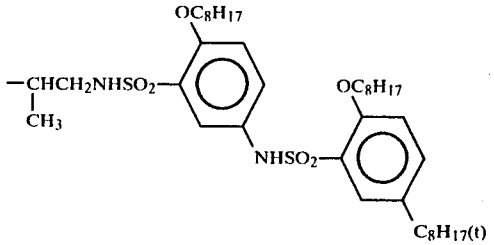 | Cl |
| M-10 | " | 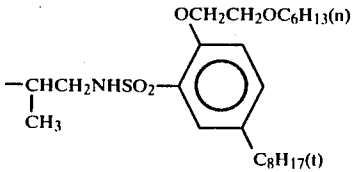 | " |
| M-11 | $(CH_3)_3C$— | 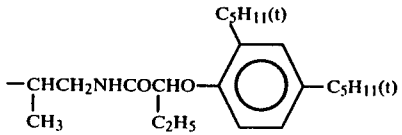 | 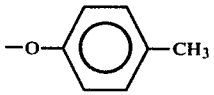 |
| M-12 | 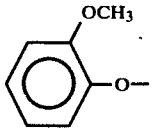 | 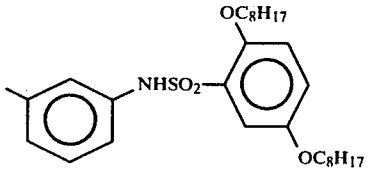 | 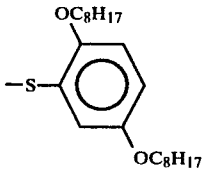 |

-continued
| Compound | $R_{10}$ | $R_{15}$ | $Y_4$ |
|---|---|---|---|
| M-13 | $CH_3$— | 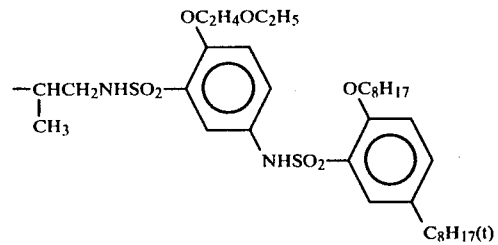 | Cl |
| M-14 | " | 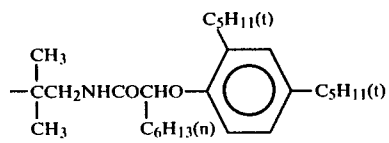 | " |
| M-15 | " | 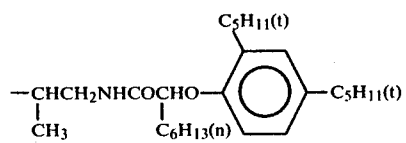 | " |
| M-16 | $CH_3$— | 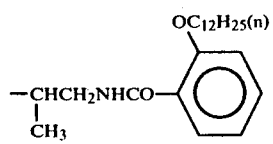 | Cl |
| M-17 | " | 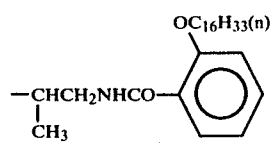 | " |

-continued
| Compound | $R_{10}$ | $R_{15}$ | $Y_4$ |
|---|---|---|---|
| M-18 | 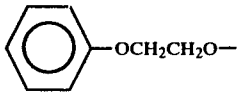 | 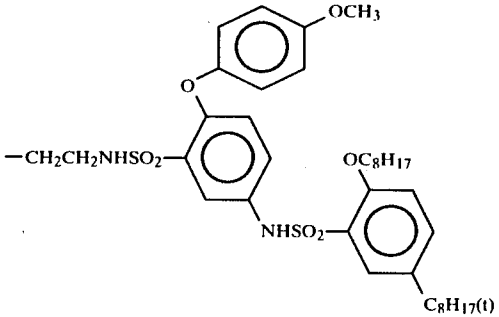 | 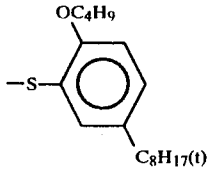 |
| M-19 | $CH_3CH_2O-$ | " | " |
| M-20 | 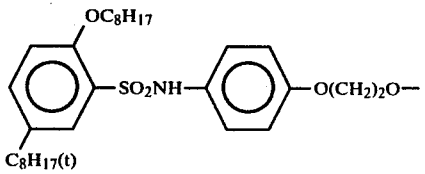 | 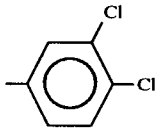 | 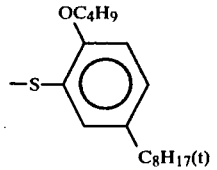 |
| M-21 | 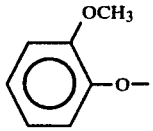 | 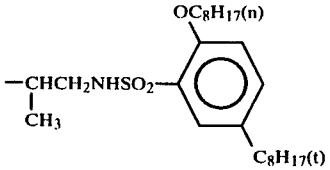 | Cl |
| | 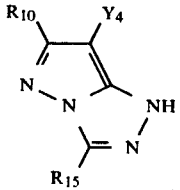 | | |
| M-22 | $CH_3-$ | 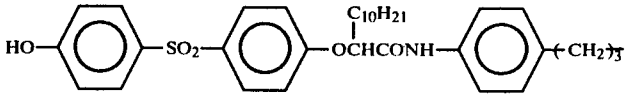 | Cl |

-continued
| Compound | $R_{10}$ | $R_{15}$ | $Y_4$ |
|---|---|---|---|
| M-23 | " | 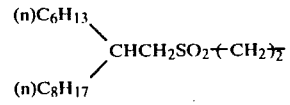 | " |
| M-24 | 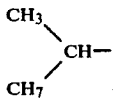 | 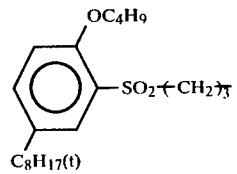 | " |
| M-25 | 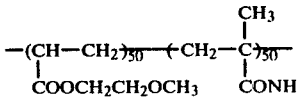 | 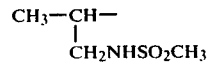 | " |
| M-26 | 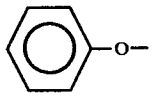 | 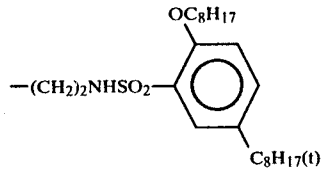 | Cl |
| M-27 | $CH_3$— | 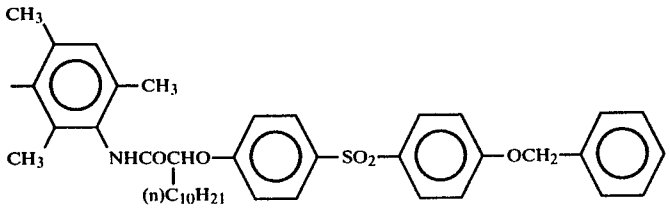 | " |
| M-28 | $(CH_3)_3C$— | 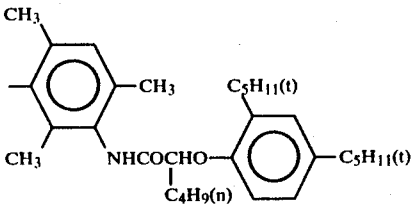 | " |

-continued
| Compound | $R_{10}$ | $R_{15}$ | $Y_4$ |
|---|---|---|---|
| M-29 | 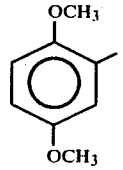 | 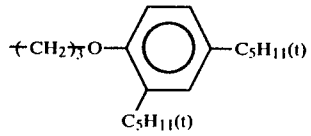 | Cl |
| M-30 | $CH_3$— | $(n)C_{18}H_{37}$<br>—CH—$NCOCH_2CH_2COOH$<br>$C_2H_5$ | " |

(Y-1)
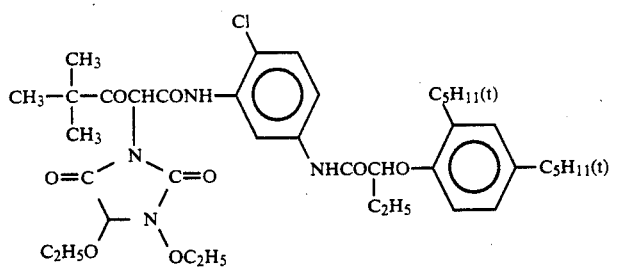
(Y-2)
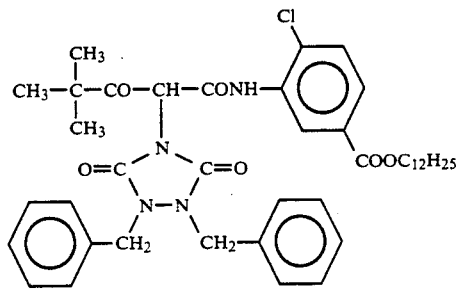
(Y-3)
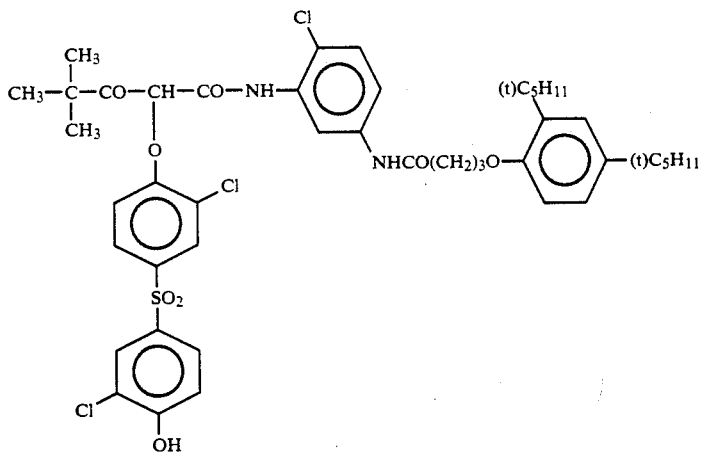
(Y-4)
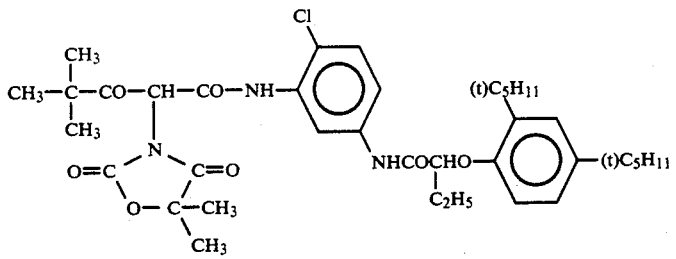
(Y-5)
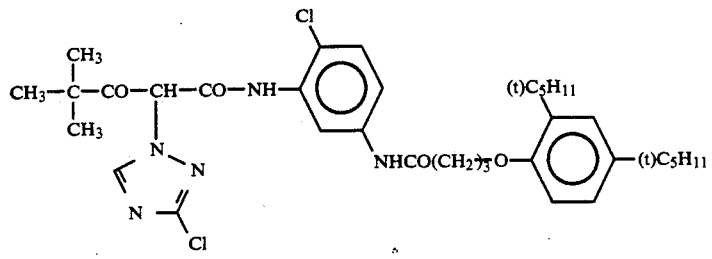

-continued (Y-6)

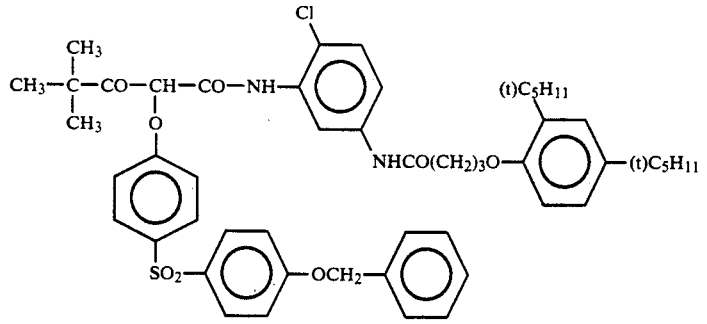

(Y-7)

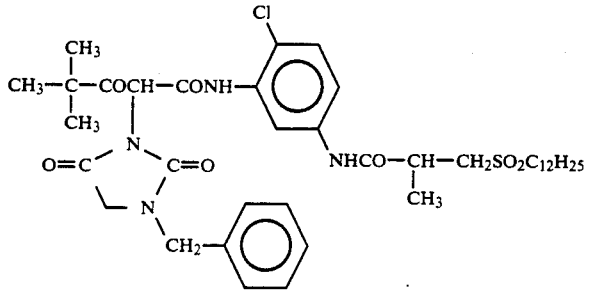

(Y-8)

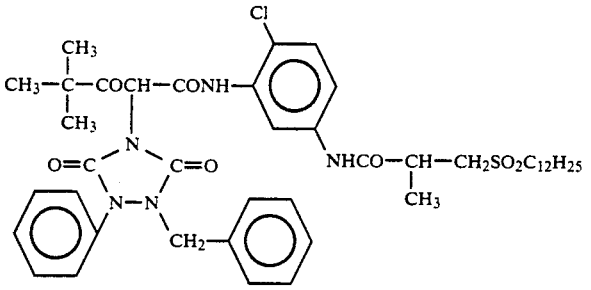

(Y-9)

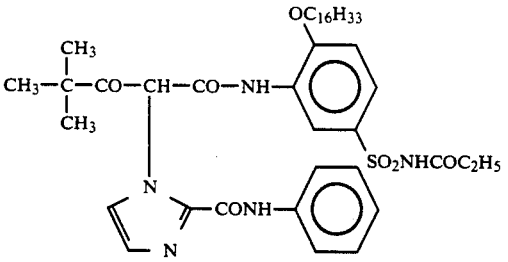

The couplers represented by the above described formulae (C-I) to (Y) are contained in a photosensitive silver halide emulsion layer generally in an amount of from 0.1 to 1.0 mol, and preferably from 0.1 to 0.5 mol, per mol of silver halide contained within the same layer.

A variety of known techniques can be used for adding the above described couplers to the photosensitive layers. Generally, the couplers can be added using a known oil drop-in-water dispersion method as an oil protection method where, after being dissolved in a solvent, the solution is emulsified and dispersed in an aqueous gelatin solution containing a surfactant. Alternatively water or an aqueous gelatin solution can be added to a coupler solution which contains a surfactant and an oil drop-in-water dispersion can be formed by phase inversion. Furthermore, alkali-soluble couplers can also be dispersed using the so-called Fischer dispersion method. Coupler dispersions can be mixed with the photographic emulsions after the removal of low boiling point organic solvents by distillation, noodle washing or ultrafiltration, for example.

The use of water-insoluble polymeric compounds and/or high boiling point organic solvents having a dielectric constant (25° C.) of from 2 to 20 and a refractive index (25° C.) of from 1.5 to 1.7 as coupler dispersion media is preferred.

The use of high boiling point organic solvents for adding the couplers to a photosensitive layer represented by the formulae (A) to (E) indicated below is preferred.

(A)

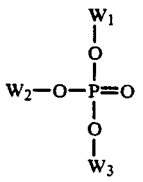

-continued $W_1-COO-W_2$ (B)

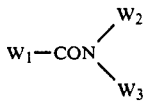
(C)

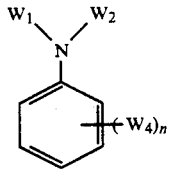
(D)

$W_1-O-W_2$ (E)

In the above formulae, $W_1$, $W_2$ and $W_3$ each represents a substituted or unsubstituted alkyl group, cycloalkyl group, alkenyl group, aryl group or heterocyclic group, $W_4$ represents $W_1$, $OW_1$ or $S-W_1$ and n represents an integer of value from 1 to 5, and when n has a value of 2 or more, the $W_4$ groups may be the same or different. Moreover, $W_1$ and $W_2$ may form a condensed ring in formula (E).

Water-immiscible compounds having a melting point of below 100° C. and having a boiling point of at least 140° C. other than those of formulae (A) to (E) can be used as the high boiling point organic solvent for use in the present invention provided that they are good solvents for the coupler. The melting point of the high boiling point organic solvent is preferably not more than 80° C. Moreover, the boiling point of the high boiling point organic solvent is preferably at least 160° C., and most preferably at least 170° C.

Details of these high boiling point organic solvents are disclosed at the lower right column on page 137 to the upper right column on page 144 of the specification of JP-A-62-215272.

Furthermore, the couplers can be loaded onto a loadable latex polymer (for example, U.S. Pat. No. 4,203,716) in the presence or absence of the above described high boiling point organic solvents, or they can be dissolved in a water-insoluble but organic solvent-soluble polymer and the solution can be emulsified and dispersed in an aqueous hydrophilic colloid solution.

The use of the homopolymers or copolymers disclosed at pages 12 to 30 of the specification of International Patent W0 88/00723 is preferred, and the use of acrylamide based polymers is especially desirable for color image stabilization, for example.

Photosensitive materials which have been prepared in accordance with the present invention may contain hydroquinone derivatives, aminophenol derivatives, gallic acid derivatives and ascorbic acid derivatives, for example, as anti-color fogging agents.

Various anti-color fading agents can be used in the photosensitive material in accordance with the present invention, including hydroquinones, 6-hydroxychromans, 5-hydroxycoumarans, spirochromans, p-alkoxyphenols, hindered phenols centering on bisphenols, gallic acid derivatives, methylenedioxybenzenes, aminophenols, hindered amines, and ether and ester derivatives in which phenolic hydroxyl groups of these compounds have been silylated or alkylated, for cyan, magenta and/or yellow images. Furthermore, metal complexes as typified by (bis-salicylaldoximato)nickel and (bis-N,N-dialkyldithiocarbamato)nickel complexes, for example, can also be used for this purpose.

Useful examples of organic anti-color fading agents are disclosed in the patent specifications indicated below.

Namely, useful hydroquinones are disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921 and U.S. Pat. Nos. 2,710,801 and 2,816,028; 6-hydroxychromans, 5-hydroxy-chromans and spirochromans are disclosed, for example, in U.S. Pat. Nos. 3,432,300, 3,573,050, 3,574,627, 3,698,909 and 3,764,337, and JP-A-52-152225; spiroindanes are disclosed in U.S. Pat. 4,360,589; p-alkoxyphenols are disclosed, for example, in U.S. Pat. No. 2,735,765, British Patent 2,066,975, JP-A-59-10539 and JP-B-57-19765; hindered phenols are disclosed, for example, in U.S. Pat. No. 3,700,455, JP-A-52-72224, U.S. Pat. No. 4,228,235 and JP-B-52-6623; gallic acid derivatives, methylene-dioxybenzenes and aminophenols are disclosed, for example, in U.S. Pat. Nos. 3,457,079 and 4,332,886, and JP-B-56-21144, respectively; hindered amines are disclosed, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; and metal complexes are disclosed, for example, in U.S. Pat. Nos. 4,050,938 and 4,241,155, and British Patent 2,027,731(A). The anti-color fading effect can be realized by adding these compounds to the photosensitive layer after co-emulsification with the corresponding color coupler, generally in an amount of from 5 to 100 wt% with respect to the coupler. The inclusion of ultraviolet absorbers in the cyan color forming layer and in the layers on both sides adjacent thereto is effective for preventing deterioration of the cyan dye image due to heat and especially upon exposure to light.

For example, benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,395), butadiene compounds (for example, those disclosed in U.S. Pat. No. 4,045,229), or benzoxazole compounds (for example, those disclosed in U.S. Pat. Nos. 3,406,070, 3,677,672 and 4,271,307) can be used as ultraviolet absorbers. Ultraviolet absorbing couplers (for example, α-naphthol based cyan dye forming couplers) and ultraviolet absorbing polymers, for example, can also be used for this purpose. These ultraviolet absorbers may be mordanted in a specified layer.

From among these compounds, the above noted aryl group substituted benzotriazole compounds are preferred.

The use together with the couplers described above of compounds (F) and (G) as those described below is most desirable in the present invention. The conjoint use of these compounds with pyrazoloazole couplers is especially desirable.

Thus, the use of compounds (F) which bond chemically with the aromatic amine based developing agent remaining after color development processing to form a compound which is chemically inert and essentially colorless and/or compounds (G) which bond chemically with the oxidant of the aromatic amine based color developing agent remaining after color development processing to form a compound which is chemically inert and essentially colorless either alone or in combination is desirable. Particularly, the compounds (F) and (G) are useful for preventing the occurrence of staining and other side effects upon storage due to colored dye formation resulting from reactions between couplers and color developing agents or oxidants thereof which remain in the film after processing, for example.

Compounds which react with p-anisidine with a secondary reaction rate constant $k_2$ (measured in trioctyl phosphate at 80° C.) within the range from 1.0 liter/mol. sec to $1\times10^{-5}$ liter/mol.sec are preferred for the compound (F). The secondary reaction rate constant can be measured using the method disclosed in JP-A-63-158545.

The compounds themselves are unstable if $k_2$ has a value above this range and they will react with gelatin or water to be decomposed. If, on the other hand, the value of $k_2$ is below this range the reaction with the residual aromatic amine based developing agent is slow and consequently the compound is ineffective for preventing the occurrence of side effects due to the residual aromatic amine based developing agent.

Preferred compounds (F) are represented by the formulae (FI) and (FII) indicated below.

$$R_1-(A)_n-X \qquad \text{(FI)}$$

$$R_2-\underset{\underset{B}{|}}{C}=Y \qquad \text{(FII)}$$

In the above formulae, $R_1$ and $R_2$ each represents an aliphatic group, an aromatic group or a heterocyclic group. Moreover, n represents 1 or 0. A represents a group which reacts with an aromatic amine based developing agent to form a chemical bond, and X represents a group which is released by reaction with an aromatic amine based developing agent. B represents a hydrogen atom, an aliphatic group, an aromatic group, a heterocyclic group, an acyl group or a sulfonyl group, and Y represents a group which promotes the addition of an aromatic amine based developing agent to the compound of formula (FII). Here, $R_1$ and X, and Y and $R_2$ or B, can be joined together to form a ring structure.

Substitution reactions and addition reactions are typical of the reactions by which the residual aromatic amine based developing agent is chemically bound.

Preferred examples of compounds represented by formulae (FI) and (FII) include those disclosed, for example, in JP-A-63-158545, JP-A-62-283338 and European Patents (Laid Open) 298,321 and 277,589.

On the other hand, the preferred compounds (G) which bond chemically with the oxidants of an aromatic amine based developing agent which remains after color development processing and form compounds which are chemically inert and colorless can be represented by formula (GI) indicated below.

$$R-Z \qquad \text{(GI)}$$

wherein R represents an aliphatic group, an aromatic group or a heterocyclic group. Z represents a nucleophilic group or a group which decomposes in the photosensitive material and then releases a nucleophilic group. Compounds represented by formula (GI) are preferably compounds in which Z is a group of which the Pearson nucleophilicity $^{n}CH_3I$ value (R. G.. Pearson et al., *J. Am. Chem. Soc.*, 90, 314 (1968)) is at least 5, or a group derived therefrom.

Examples of compounds which can be represented by formula (GI) disclosed, for example, in European Patent (Laid Open) 255,722, JP-A-62-143048, JP-A-62-229145, JP-A-1-230039, JP-A-1-57259, and European Patents (Laid Open) 298,321 and 277,589 are preferred.

Furthermore, details of combinations of the above described compounds (G) and compounds (F) have been disclosed in European Patent (Laid Open) No. 277,589.

Water-soluble dyes and dyes which become water-soluble as a result of photographic processing may be included in the hydrophilic colloid layers, for example, as filter dyes or for antiirradiation or antihalation purposes or for various other reasons, of a photo-sensitive material prepared in accordance with the present invention. Dyes of this type include oxonol dyes, hemioxonol dyes, styryl dyes, merocyanine dyes, cyanine dyes and azo dyes. The oxonol dyes, hemioxonol dyes and merocyanine dyes are preferred among these dyes.

Gelatin is useful as a binding agent or protective colloid for use in the emulsion layers of a photo-sensitive material of the present invention, but other hydrophilic colloids, either alone or in conjunction with gelatin, can be used for this purpose.

The gelatin for use in the present invention may be a lime treated gelatin, or a gelatin which has been treated using an acid. Details of the preparation of gelatins are disclosed by Arthur Weise in *The Macromolecular Chemistry of Gelatin* (published by Academic Press, 1964).

For example, hydrophilic colloids other than gelatin for use in the present invention include gelatin derivatives, graft polymers of gelatin and other polymers and proteins such as albumin and casein; cellulose derivatives such as hydroxyethyl cellulose, carboxymethyl cellulose, hydroxypropyl cellulose and cellulose sulfate esters; sugar derivatives such as sodium alginate, pyrodextran and starch derivatives, and homopolymers such as poly(vinyl alcohol); partially acetalated poly(vinyl alcohol), poly(vinyl alcohol) which has been modified with anionic compounds and cationic compounds, poly(N-vinylpyrrolidone), poly(acrylic acid) and the neutralized products thereof, poly(methacrylic acid) and the neutralized products thereof, polyacrylamide, polyvinylimidazole and polyvinylpyrazole, for example, and copolymers of these materials.

The hydrophilic polymers included in the gelatin can be crosslinked appropriately to increase the initial swelling.

The total amount of hydrophilic colloid contained in the photosensitive material in accordance with the present invention is preferably from 2.0 to 8.0 g/m$^2$, and more preferably from 3.5 to 6.0 g/m$^2$. If the amount of hydrophilic colloid exceeds this range, development, especially the initial development, is retarded, and if the amount of hydrophilic colloid is too low, the physical properties of the film while wet are adversely affected.

Well known film hardening agents can be used, either individually or in combinations, the photosensitive material in accordance with the present invention.

Useful film hardening agents include, for example, chromium salts (for example, chrome alum, chromium acetate), aldehydes (for example, formaldehyde, glyoxal, glutaraldehyde), N-methylol compounds (for example, dimethylolurea, methyloldimethylhydantoin), dioxane derivatives (for example, 2,3-dihydroxydioxane), active vinyl compounds (for example, 1,3,5-triacryloylhexahydro-2-triazine, 1,3-vinylsulfonyl-2-propanol), active halogen compounds (for example, 2,4-dichloro-6-hydroxy-3-triazine) and mucohalogen acids (for example, mucochloric acid, mucophenoxychloric acid).

The film hardening agents preferred for use include, for example, aldehyde based compounds such as formaldehyde and glyoxal, s-triazine based compounds such as 2-hydroxy-4,6-dichlorotriazine sodium salt, and vinylsulfone based compounds.

The amount of film hardening agent used varies depending on the presence of film hardening promotors or film hardening restrainers, but an addition amount within the range from $1\times10^{-6}$ mol/g-gelatin to $1\times10^{-2}$ mol/g-gelatin is generally employed. More desirably, the addition amount is within the range from $5\times10^{-5}$ mol/g-gelatin to $5\times10^{-3}$ mol/g-gelatin.

Examples of useful film hardening agents include those indicated below.

HCHO (1)

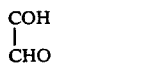
(2)

$CH_3CHO$ (3)

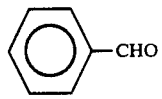
(4)

$OHC{\leftarrow}CH_2{\rightarrow}_3CHO$ (5)

$ClCH_2CONHCOCH_2Cl$ (6)

$ClCH_2COOCH_2CH_2OOCCH_2Cl$ (7)

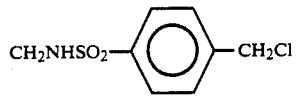
(8)

$CH_3COCl$ (9)

$CH_3COCH_2Cl$ (10)

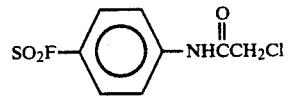
(11)

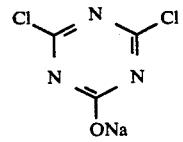
(12)

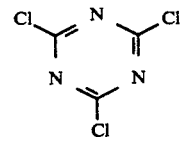
(13)

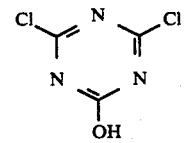
(14)

-continued
(15)
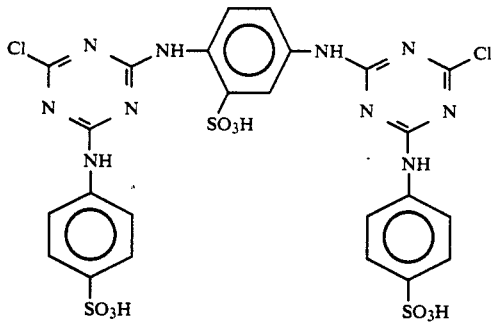
$CH_2{=}CHSO_2(CH_2)_3SO_2CH{=}CH_3$ (16)
(17)
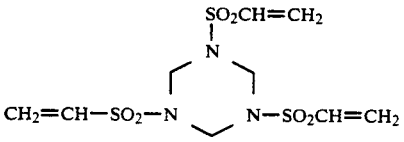
$C(CH_2SO_2CH{=}CH_2)_4$ (18)
(19)
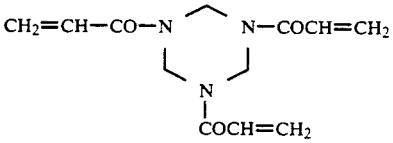
$CH_2{=}CHCOOCOCH{=}CH_2$ (20)
$CH_2{=}CH{-}O{-}CH{=}CH_2$ (21)
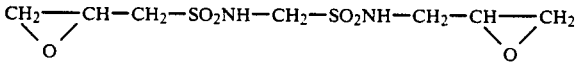
(22)
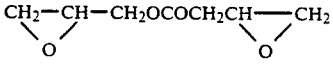
(23)
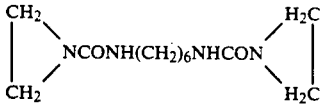
(24)
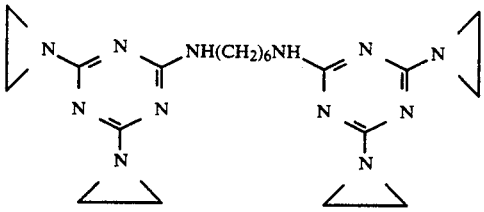
(25)
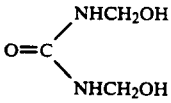
(26)
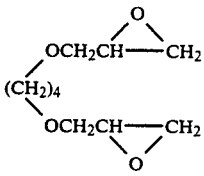
(27)

-continued $$(CH_2{=}CHSO_2 \cdot CH_2CONHCH_2)_2 \quad (28)$$

A film hardening aid may be used together with a film hardening agent to harden a hydrophilic colloid film. Agents which break down hydrogen bonding such as thiourea and urea, for example, and aromatic hydrocarbons which have hydroxy groups such as hydroquinone, for example, are useful film hardening aids.

Moreover, the film hardening agent can be polymerized such that only the layer to which the agent is added is hardened.

Transparent films, such as cellulose nitrate films and poly(ethylene terephthalate) films, and reflective supports generally used in photographic materials can be used as the support of the photosensitive material in accordance with the present invention. The use of a reflective support is preferred for best achieving the objectives of the present invention.

The "reflective support" for use in the present invention is a support having a high reflectivity which brightens the dye image formed in the silver halide emulsion layer, and includes supports covered with a hydrophobic resin containing a dispersion of a light reflecting material, such as titanium oxide, zinc oxide, calcium carbonate or calcium sulfate, and supports comprising a hydrophobic resin containing a light reflecting substance. Examples of such supports include baryta paper, polyethylene coated paper, polypropylene based synthetic paper and transparent supports such as glass plates, polyester films such as poly(ethylene terephthalate), cellulose triacetate and cellulose nitrate films, polyamide films, polycarbonate films, polystyrene films and vinyl chloride resins, on which a reflective layer has been established or wherein a reflective substance is used conjointly.

Supports which have a metal surface with mirror like reflection properties or secondary diffuse reflection properties can also be used as a reflective type support for use in the present invention. The spectral reflectance in the visible wavelength region of a metal surface is at least 0.5, and diffuse reflection properties may be obtained by roughening the surface or by using a metal powder. Aluminum, tin, silver, magnesium or alloys thereof can be used, for example, as the metal, and the surface may take the form of a metal sheet, a metal foil or a thin metal surface layer obtained by rolling, vapor deposition or plating, for example. Among these materials, those obtained by vapor depositing metal on a substrate are preferred. The establishment of a water-insoluble resin, and preferably a thermoplastic resin layer over the metal surface is desirable. An antistatic layer may also be established on the opposite side of the metal surface side of the support for use in the present invention. Details of such supports are disclosed, for example, in JP-A-61-210346, JP-A-63-24247, JP-A-63-24251 and JP-A-63-24255.

The support is appropriately selected depending on the intended use.

The use of a white pigment which has been milled satisfactorily in the presence of a surfactant and the particle surfaces of which have been treated with a dihydric-tetrahydric alcohol is preferred for the light reflecting substance.

The occupied surface ratio of fine white pigment particles per specified unit area (%) can be determined by dividing the area under observation into adjoining $6\times6$ $\mu$m unit areas and measuring the occupied area ratio (%) ($R_i$) of the fine particles projected in each unit area. The variation coefficient of the occupied area ratio (%) can be obtained by means of the ratio $s/\overline{R}$ of the standard deviation s for $R_i$ with respect to the average value ($\overline{R}$) of $R_i$. The number of unit areas taken for observation (n) is preferably at least 6. Hence, the variation coefficient can be obtained by means of the following expression:

$$S/\overline{R} = \frac{\sqrt{\dfrac{\sum_{n=1}^{n} (R_i - R)^2}{n-1}}}{\dfrac{\sum_{i=1}^{n} R_i}{n}}$$

In the present invention, the variation coefficient of the occupied area ratio (%) of the fine pigment particles is not more than 0.15, and preferably not more than 0.12. The diffusion properties of the particles is said to be "uniform" in practice in those cases where the value is not more than 0.08.

The color photographic material in accordance with the present invention is preferably subjected to color development, bleach-fixing and water washing (or stabilization) processes. Bleaching and fixing can be carried out separately rather than in a single bath as indicated above.

Known primary aromatic amine color developing agents can be contained in the color developer for use in the present invention. The p-phenylenediamine derivatives are preferred and typical examples are indicated below, but the developing agent is not limited thereto.

D- 1 N,N-Diethyl-p-phenylenediamine
D- 2 4-Amino-N,N-diethyl-3-methylaniline
D- 3 4-Amino-N-(β-hydroxyethyl)-N-methylaniline
D- 4 4-Amino-N-ethyl-N-(β-hydroxyethyl)aniline
D- 5 4-Amino-N-ethyl-N-(β-hydroxyethyl.)-3-methylaniline
D- 6 4-Amino-N-ethyl-N-(3-hydroxypropyl)-3-methylaniline
D- 7 4-Amino-N-ethyl-N-(4-hydroxybutyl)-3-methylaniline
D- 8 4-Amino-N-ethyl-N-(β-methanesulfonamidoethyl)-3-methylaniline
D- 9 4-Amino-N,N-diethyl-3-(β-hydroxyethyl)aniline
D-10 4-Amino-N-ethyl-N-(β-methoxyethyl)-3-methylaniline
D-11 4-Amino-N-(β-ethoxyethyl)-N-ethyl-3-methylaniline
D-12 4-Amino-N-(3-carbamoylpropyl)-N-n-propyl-3-methyl-aniline
D-13 4-Amino-N-(4-carbamoylbutyl)-N-n-propyl-3-methyl-aniline
D-14 N-(4-Amino-3-methylphenyl)-3-propoxypyrrolidine
D-15 N-(4-Amino-3-methylphenyl)-3-(hydroxymethyl)-pyrrolidine
D-16 N-(4-Amino-3-methylphenyl)-3-pyrrolidinecarboxide Exemplary Compounds D-5, D-6, D-7, D-8 and D-12 are preferred among the above noted p-phenylenediamine derivatives. Furthermore, these p-phenylenediamine derivatives may take the form of a salt, such as a sulfate, hydrochloride, sulfite, or p-toluenesulfonate, for example. The content of the primary aromatic amine developing agent is preferably from 0.002 mol to 0.2 mol, and more preferably from 0.005 mol to 0.1 mol, per liter of developer.

The use of a substantially benzyl alcohol free developer is preferred for the execution of the present invention. Here, the term "substantially benzyl alcohol free" means that the benzyl alcohol concentration is preferably not more than 2 ml/liter, more preferably not more than 0.5 ml/liter, of the developer. Most preferably, the developer contains no benzyl alcohol.

The color developer for use in the present invention is preferably substantially sulfite ion free. The sulfite ion has a silver halide dissolving action and also reacts with the oxidant of the developing agent as well. Sulfite ion functions as a preservative for the developing agent, and it has the effect of reducing the efficiency with which dyes are formed. It has been be determined that effects of sulfite ion can result in considerable change in photographic performance during continuous processing. Here, the term "substantially sulfite ion free" means that the sulfite ion concentration is preferably not more than $3.0\times10^{-3}$ mol/liter of the developer. Most preferably, the developer contains no sulfite ion. However, in the present invention, a small amount of sulfite ion (about $1\times10^{-5}$ mol/liter or less) which is used for preventing oxidation of processing kits containing the developing agent concentrated prior to dilution for use is considered to be excluded.

The color developer for use in the present invention is preferably substantially sulfite ion free, but more preferably is substantially hydroxylamine free. This is because hydroxylamine itself has a silver developing activity and also functions as a preservative for the developer. It is considered that changes in the hydroxylamine concentration have a marked effect on photographic characteristics. Here, the term "substantially hydroxylamine free" means a hydroxylamine concentration of not more than $5.0\times10^{-3}$ mol/liter of the developer. Most preferably, the developer contains no hydroxylamine at all.

The color developer for use in the present invention most preferably contains an organic preservative in place of the above noted hydroxylamine and sulfite ion in an amount of 1/10 to 10 times the total amount of hydroxylamine and sulfite ion.

Here, an "organic preservative" is an organic compound which, when added to a processing bath for processing a color photographic material, reduces the speed of deterioration of the primary aromatic amine color developing agent. Namely, an organic preservative functions to prevent the aerial oxidation of color developing agent, for example, and among these compounds the hydroxylamine derivatives (except hydroxylamine), hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamide compounds and condensed ring amines, for example, are especially effective organic preservatives. Organic preservatives are disclosed, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

The various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349, and the aromatic polyhydroxy compounds disclosed, for example, in U.S. Pat. No. 3,746,544, etc., can also be included, if desired, as preservatives. The addition of alkanolamines such as triethanolamine, dialkylhydroxylamines such as diethylhydroxylamine, hydrazine derivatives or aromatic polyhydroxy compounds is especially desirable.

Among the above noted organic preservatives, the hydroxylamine derivatives and hydrazine derivatives (hydrazines and hydrazones) are especially desirable as disclosed, for example, in JP-A-1-97953, JP-A-1-186939, JP-A-1-186940 and JP-A-1-187557.

Furthermore, the conjoint use of amines with the above noted hydroxylamine derivatives or hydrazine derivatives is desirable for increasing the stability of the color developer and for increasing stability during continuous processing.

The above noted amines may be amines such as the cyclic amines disclosed in JP-A-63-239447, the amines disclosed in JP-A-63-128340 or other amines such as those disclosed in JP-A-1-186939 and JP-A-1-187557.

The inclusion of from $3.5\times10^{-2}$ to $1.5\times10^{-1}$ mol/liter of chloride ion in the color developer is desirable in the present invention. The inclusion of from $4\times10^{-2}$ to $1\times10^{-1}$ mol/liter is especially desirable. There is a disadvantage in that development is retarded if the chloride ion concentration is greater than $1.5\times10^{-1}$ mol/liter, and this is undesirable for quickly attaining a high maximum density (i.e., an objective of the present invention). Furthermore, the presence of less than $3.5\times10^{-2}$ mol/liter is ineffective for preventing fogging.

Bromide ion is preferably included in an amount of from $3.0\times10^{-5}$ mol/liter to $1.0\times10^{-3}$ mol/liter in the color developer in the present invention. It is most preferably included in an amount of from $5.0\times10^{-5}$ to $5\times10^{-4}$ mol/liter. Development is retarded and there is a reduction in maximum density and photographic speed in cases where the bromide ion concentration exceeds $1\times10^{-3}$ mol/liter, and fogging is not effectively prevented if the bromide ion concentration is less than $3.0\times10^{-5}$ mol/liter.

The chloride ion and the bromide ion may be added directly to the developer, or may originate by dissolving out of the photosensitive material into the developer during development processing.

Sodium chloride, potassium chloride, ammonium chloride, lithium chloride, nickel chloride, magnesium chloride, manganese chloride, calcium chloride and cadmium chloride can be used as a chloride ion source in the case of direct addition to the color developer, and of these the use of sodium chloride and potassium chloride is preferred.

Furthermore, the chloride ion can be supplied from a fluorescent brightening agent which has been added to the developer.

Sodium bromide, potassium bromide, ammonium bromide, lithium bromide, calcium bromide, magnesium bromide, manganese bromide, nickel bromide, cadmium bromide, cerium bromide and thallium bromide can be used as a bromide ion source, and of these, potassium bromide and sodium bromide are preferred.

In those cases where the chloride and/or bromide ion are dissolved out from the photosensitive material during development processing, the chloride and bromide ion may be supplied together from an emulsion layer or from a source other than an emulsion layer.

The color developer for use in the present invention preferably has a pH of from 9 to 12, and most preferably a pH of from 9 to 11.0. Known developing component compounds can be included in the color developer.

The use of various buffers is desirable for maintaining the above noted pH level. Thus, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts and lysine salts, for example, can be used as buffers. Carbonates, phosphates, tetraborates and hydroxybenzoates have the advantage of providing excellent solubility and buffering ability in the high pH range of pH 9.0 and above, which buffers do not adversely affect photographic performance (to cause fogging, for example) when added to a color developer and which are inexpensive, and the use of these buffers is especially desirable.

Examples of useful buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

The buffer is added to the color developer preferably in an amount of at least 0.1 mol/liter, and more preferably in an amount of from 0.1 to 0.4 mol/liter.

Various chelating agents can also be added to the color developer to prevent the precipitation of calcium and magnesium in the color developer, or for improving the stability of the color developer. For example, nitrilotriacetic acid, diethylenetriaminepentaacetic acid, ethylenediaminetetraacetic acid, N,N,N-trimethylenephosphonic acid, ethylenediamine-N,N,N,,N,-tetramethylenesulfonic acid, trans-cyclohexanediaminetetraacetic acid, 1,2-diaminopropanetetraacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid and N,N,-bis(2-hydroxybenzyl)ethylenediamine-N,N,-diacetic acid can be used.

Two or more of these chelating agents can be used together, if desired.

The addition amount of chelating agent should be sufficient to mask the metal ions which are present in the color developer, and an amount of from 0.1 g to 10 g per liter can generally be used.

A development accelerator can be added to the color developer, if desired.

For example, the thioether compounds disclosed, for example, in JP-B-37-16088, JP-B-37-5987, JP-B-38-7826, JP-B-44-12380, JP-B-45-9019 and U.S. Pat. No. 3,813,247, the p-phenylenediamine based compounds disclosed in JP-A-52-49829 and JP-A-50-15554, the quaternary ammonium salts disclosed, for example, in JP-A-50-137726, JP-B-44-30074, JP-A-56-156826 and JP-A-52-43429, the amine based compounds disclosed, for example, in U.S. Pat. Nos. 2,494,903, 3,128,182, 4,230,796 and 3,253,919, JP-B-41-11431, and U.S. Pat. Nos. 2,482,546, 2,596,926 and 3,582,346, the poly(alkylene oxides) disclosed, for example, in JP-B-37-16088, JP-B-42-25201, U.S. Pat. No. 3,128,183, JP-B-41-11431, JP-B-42-23883, and U.S. Pat. No. 3,532,501, and also 1-phenyl-3-pyrazolidones and imidazoles, for example, can be added as a development accelerator.

An antifoggant can also be added to the color developer of the present invention, if desired. Alkali metal halides, such as sodium chloride, potassium bromide and potassium iodide, and organic antifoggants, can be used as an antifoggant. Typical examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The addition of a fluorescent brightening agent in the color developer for use in the present invention is desirable. 4,4,-Diamino-2,2,-disulfostilbene based compounds are preferred as fluorescent brightening agents. The amount added is generally from 0 to 5 g/liter, and preferably from 0.1 to 4 g/liter of the color developer.

Furthermore, various surfactants, such as alkylsulfonic acids, arylsulfonic acids, aliphatic carboxylic acids and aromatic carboxylic acids, for example, can be added, if desired.

The processing temperature of the color developer for use in the present invention is from 20° C. to 50° C., and preferably from 30° C. to 45° C. The processing time is not more than 20 seconds, and preferably is not more than 15 seconds. A low replenishment rate is preferred, and suitable replenishment can be carried out at a rate of from 20 to 600 ml, preferably from 30 to 300 ml, more preferably from 40 to 200 ml, and most preferably from 60 to 150 ml, per square meter of photosensitive material being processed.

The desilvering process for use in the present invention is described below. The desilvering process is generally comprised of a bleaching process and a fixing process, a fixing process and a bleach-fixing process, a bleaching process and a bleach-fixing process, or a bleach-fixing process, for example.

Bleaching solutions, bleach-fixing solutions and fixing solutions used in the present invention are described below.

Bleaching agents other that the above described organic complex salts of iron(III) can be used together with the organic complex salts of iron(III), for example, in a bleaching or a bleach-fixing solution and can also be used in other processing baths having a bleaching ability. Known bleaching agents may be used, but organic acids such as citric acid, tartaric acid and malic acid, persulfate and hydrogen peroxide, for example, are preferred.

Various compounds can be added as a bleaching accelerator in the bleaching solution, bleach-fixing solution or bleaching or bleach-fixing prebaths. For example, the compounds having a mercapto group or a disulfide bond as disclosed in U.S. Pat. No. 3,893,858, German Patent 1,290,812, JP-A-53-95630 and *Research Disclosure*, No. 17129 (July, 1978); the thiourea based compounds as disclosed JP-B-45-8506, JP-A-52-20832, JP-A-53-32735 and U.S. Pat. No. 3,706,561; or halides, such as iodide or bromide ions, are preferred for use as a bleaching accelerator in view of their superiority in bleaching power.

Rehalogenating agents, such as bromides (for example, potassium bromide, sodium bromide, ammonium bromide) or chlorides (for example, potassium chloride, sodium chloride, ammonium chloride) or iodides (for example, ammonium iodide) can also be included in the bleaching or bleach-fixing solution for use in the present invention. One or more inorganic acid or organic acids, or the alkali metal or ammonium salts thereof having a pH buffering ability, such as borax, sodium metaborate, acetic acid, sodium acetate, sodium carbonate, potassium carbonate, phosphorous acid, phosphoric acid, sodium phosphate, citric acid, sodium citrate or tartaric acid, for example, and corrosion inhibitors such as ammonium nitrate and guanidine, for example, can be added, if desired.

Known fixing agents including thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and water-soluble silver halide solvents (dissolving agents) such as the thioureas, for example, can be used as fixing agents in the bleach-fixing and fixing solution, and these compounds can be used alone, or two or more types of these compounds can be used together. Special bleach-fixing solutions consisting of a combination of large quantities of a halide such as potassium iodide and a fixing agent as disclosed in JP-A-55-155354 can also be used. The use of thiosulfates, and especially ammonium thiosulfate, is preferred in the present invention. The amount of fixing agent per liter is preferably within the range of from 0.3 to 2 mol, and most preferably within the range of from 0.5 to 1.0 mol. The pH range of the bleach-fixing or fixing solution in the present invention is preferably from 3 to 10, and more preferably from 5 to 9.

The processing temperature of bleach-fixing or fixing solution is selected depending on the application of the photosensitive material, but generally is from 25° C. to 60° C., and preferably from 35° C. to 50° C. The processing time is desirably set to be as short as possible for rapid processing while still providing good desilvering. The processing time is preferably from 10 to 60 seconds, more preferably from 15 to 40 seconds, and most preferably from 15 to 25 seconds.

Furthermore, various fluorescent brightening agents, antifoaming agents or surfactants, polyvinylpyrrolidone and organic solvents such as methanol can be included in the bleach-fixing solution.

The addition of sulfite ion releasing compounds such as sulfites (for example, sodium sulfite, potassium sulfite, ammonium sulfite), bisulfites (for example, ammonium bisulfite, sodium bisulfite, potassium bisulfite) and metabisulfites (for example, potassium metabisulfite, sodium metabisulfite, ammonium metabisulfite) as a preservative in the bleach-fixing and fixing solution is desirable. These compounds are preferably used at a concentration, calculated as sulfite ion, of preferably from about 0.02 to 0.50 mol/liter, and more preferably at a concentration, as sulfite ion, of from 0.04 to 0.40 mol/liter.

Sulfites are generally added as the preservative, but ascorbic acid and carbonyl/bisulfite addition compounds or carbonyl compounds, for example, can also be added.

Buffers, fluorescent brightening agents, chelating agents, antifoaming agents and fungicides, for example, can also be added, if desired.

A water washing process and/or stabilization process (unless indicated to the contrary, stabilization processes are included in the term water washing process hereinafter) is carried out after the desilvering process, such as a fixing or bleach-fixing process.

The amount of washing water used in a washing process is selected within a wide range, depending on the characteristics ( e.g., type of couplers employed) and the application of the photosensitive material, the washing water temperature, the number of water washing tanks (i.e., the number of water washing stages), the type of replenishment system, i.e., whether a countercurrent or cocurrent system is used, and various other factors. The relationship between the amount of water used and the number of washing tanks in a multistage countercurrent system can be obtained using the method outlined on pages 248 to 253 of the *Journal of the Society of Motion Picture and Television Engineers*, Vol. 64 (May, 1955). The number of stages in a multistage countercurrent system is preferably from 2 to 6, and more preferably from 2 to 4.

The amount of washing water can be greatly reduced by using a multistage countercurrent system, and washing can be achieved with not more than from 0.5 to 1 liter of water per square meter of photosensitive material processed, for example, and the effect of the present invention is pronounced. However, bacteria proliferate due to the increased residence time of the water in the tanks and problems arise with suspended matter which is thereby produced and adheres to the photosensitive material. The method in which the calcium ion and magnesium ion concentrations are reduced, as disclosed in JP-A-62-288838, can be used very effectively as a means of overcoming these problems. Furthermore, the isothiazolone compounds and thiabendazoles disclosed in JP-A-57-8542, the chlorine based disinfectants such as chlorinated sodium isocyanurate disclosed in JP-A-61-120145, the benzotriazole disclosed in JP-A-61-267761, copper ion, and the disinfectants disclosed in *The Chemistry of Biocides and Fungicides* by Horiguchi (1986), in *Killing Microorganisms, Biocidal and Fungicidal Techniques* published by the Health and Hygiene Technical Society (1982), and in *A Dictionary of Biocides and Fungicides* published by the Japanese Biocide and Fungicide Society (1986), can also be used in this regard.

Moreover, surfactants can be added as a hydroextracting agent, and chelating agents as typified by EDTA can be used as a hard water softening agent, in the water washing water.

A direct stabilization process can be carried out following, or in place of, the above described water washing process. Compounds having an image stabilizing function can be added to the stabilizing solution, and aldehydes such as formaldehyde, for example, buffers for adjusting the film pH to a level which is suitable for providing dye stability, and ammonium compounds can be added to the stabilizer. Furthermore, the various above described biocides and fungicides can be used to prevent the proliferation of bacteria in the bath and to provide the processed photosensitive material with biocidal properties.

Moreover, surfactants, fluorescent brightening agents and film hardening agents can also be added.

The addition of chelating agents in the water washing processing baths of the present invention is desirable.

Useful chelating agents can be selected from the aminopolycarboxylic acids, aminopolyphosphonic acids, phosphonocarboxylic acids, alkylidenediphosphonic acids, metaphosphoric acid, pyrophosphoric acid and polyphosphoric acid, for example. Actual examples of chelating agents are indicated below, but the present invention is not limited by these examples.

K-1

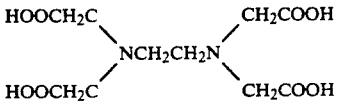

K-2

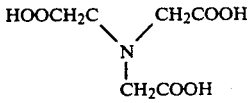

K-3

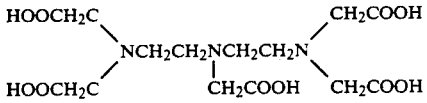

K-4

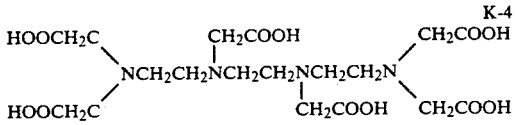

K-5

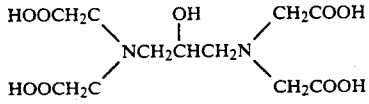

K-6

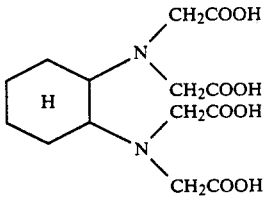

K-7

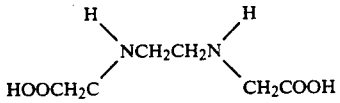

K-8

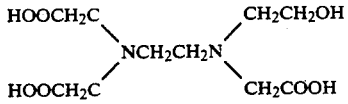

K-9

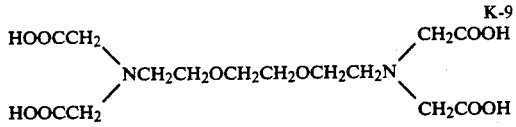

K-10

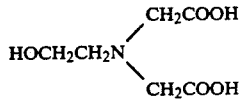

K-11

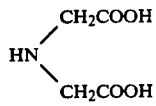

-continued

K-12

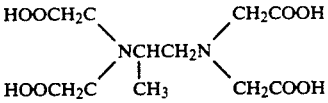

K-13

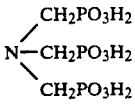

K-14

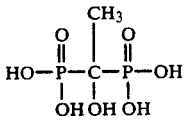

K-15

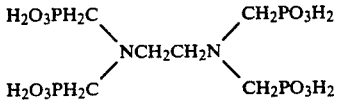

K-16

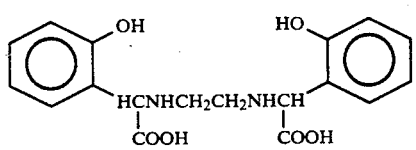

K-17

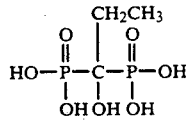

K-18

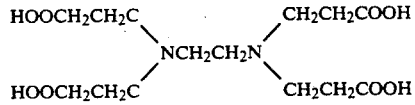

K-19

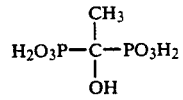

K-20

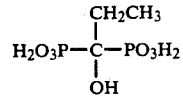

K-21

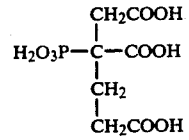

K-22

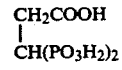

K-23

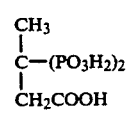

K-24

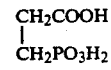

-continued

K-25

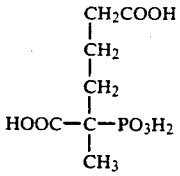

K-26

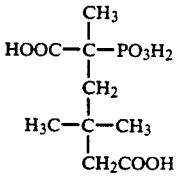

K-27

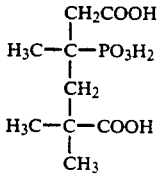

K-28

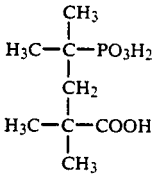

K-29

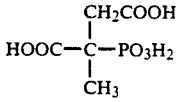

K-30

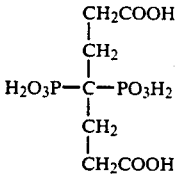

K-31

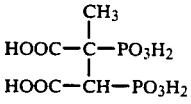

K-32

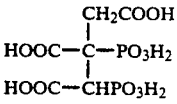

K-33

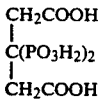

K-34

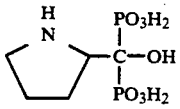

K-35

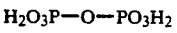

The alkylidenediphosphonic acids are especially effective among the chelating agents indicated above. The amount of chelating agent added is preferably from 1 to 100 g, and more preferably from 5 to 50 g, per liter of water washing bath.

The pH of the water washing or stabilization process is preferably from 4 to 10, and a pH of from 5 to 8 is most desirable. The processing temperature is selected depending on the application and characteristics of the photosensitive material, but in general the temperature is from 30° C. to 55° C., and preferably from 35° C. to 50° C. The water washing or stabilization process time is set to be as short as possible for rapid processing. The time is preferably from 10 seconds to 45 seconds, and more preferably from 10 seconds to 35 seconds. A lower replenishment rate is preferred with respect to operating cost and the amount of effluent and operability (handling property), for example.

The replenishment rate for the water washing or stabilization process is from 0.5 to 50 times, and preferably from 2 to 15 times, the carry-over from the preceding bath per unit area of photosensitive material. Furthermore, it is generally not more than 300 ml, and preferably not more than 150 ml, per square meter of photosensitive material. Furthermore, replenishment can be carried out continuously or intermittently.

The solution which has been used in the water washing and/or stabilization process can also be used in a preceding process. For example, the amount of washing water is reduced using a multistage countercurrent system and the overflow of water washing water can be introduced into the preceding bleach-fixing bath, a concentrated solution can be added to the bleach-fixing bath for replenishment and the amount of waste solution can be reduced in this manner.

A jet-flow of washing water and/or stabilizer or other processing solution in the present invention can be provided by withdrawing processing solution from a processing bath by means of a pump and discharging the processing solution towards the emulsion surface of the photosensitive material from a nozzle or slit which has been established in a position facing the emulsion surface. In more practical terms, the method in which solution is discharged under pressure with a pump from a slit or a nozzle which is established facing the emulsion surface as disclosed in the illustrative examples from the lower right hand column on page 3 to the lower right hand column of page 4 of the specification of JP-A-62-183460 can be adopted.

The drying process for use in the present invention is described below.

Thus, a drying time of from 10 seconds to 40 seconds is desirable for completing the image in the ultra-rapid processing of the present invention.

Means of shortening the drying time include reducing the carry-over of water in the film by reducing the amount of hydrophilic binder such as gelatin, for example, on the sensitive material side. Furthermore, drying can be speeded up by absorbing the water with a cloth or using a squeegee roller immediately after emerging from the water washing tank in order to reduce the amount of carry-over. Furthermore, rapid drying can be achieved by raising the drying temperature or by using a drying air having a reduced moisture content. Moreover, drying can be speeded up by adjusting the angle of incidence of the air drying stream on the sensitive material and by removing the moisture laden air.

ILLUSTRATIVE EXAMPLES

The present invention is described in practical terms below by means of the following illustrative examples, but the present invention is not to be construed as being limited to these examples.

EXAMPLE 1

A water resistant resin layer of thickness 30 μm was formed by coating by melt extrusion of a mixture obtained by immersing titanium oxide powder in an ethanolic solution of 2,4-dihydroxy-2-methylpentane and heating to evaporate off the ethanol and adding and milling 14 wt% of the surface treated anatase type titanium oxide dye pigment thus obtained in 89 wt parts of a polyethylene composition (density: 0.920 g/ml, melt index (MI): 5.0 g/10 minutes) on the surface of a white paper LBKP (deciduous tree bleach sulfate pulp) 100% for photographic printing paper purposes. A water resistant resin layer of the polyethylene composition was also established on the reverse side of the white base paper. Moreover, after subjecting both sides of the paper support which had been laminated on both sides with polyethylene to a corona discharge treatment, a gelatin underlayer which contained sodium dodecylbenzenesulfonate was provided thereon, and a multilayer color printing paper having the layer structure described below was prepared by coating the various photographic layers. The coating solutions were prepared as described below.

Preparation of the First Layer Coating Solution

Ethyl acetate (27.2 ml) and 4.1 g each of solvent (Solv-3) and solvent (Solv-7) were added to 19.1 g of yellow coupler (ExY), 4.4 g of color image stabilizer (Cpd-1) and 0.7 g of color image stabilizer (Cpd-7) to form a solution which was then emulsified and dispersed in 185 ml of a 10 wt% aqueous gelatin solution which contained 8 ml of 10 wt% sodium dodecylbenzenesulfonate to provide emulsified dispersion A. On the other hand, the silver chlorobromide emulsion A (a 3/7 (Ag mol ratio) mixture ratio of a large size cubic emulsion A of average grain size 0.88 μm and a small size cubic emulsion A of average grain size 0.70 μm; the variation coefficients of the grain size distributions being 0.08 and 0.10, respectively, each of the large and small size emulsions A had 0.3 mol% silver bromide included locally on part of the grain surface) was prepared. The blue sensitive sensitizing dyes A and B indicated below were each added in an amount of $2.0\times10^4$ mol per mol of silver in the large size cubic emulsion A and in an amount of $2.5\times10^4$ mol per mol of silver halide in the small size cubic emulsion A. Furthermore, the emulsion was chemically sensitized with the addition of a sulfur sensitizing agent and a gold sensitizing agent. This silver chlorobromide emulsion A was mixed with the above described emulsified dispersion A to prepare a first layer coating solution having the composition indicated below.

The coating solutions for the second to the seventh layers were prepared using a similar procedure as for the first layer coating solution. 1-Oxy-3,5-dichloro-s-triazine sodium salt was added as a gelatin hardening agent in each layer in an amount of 1.3 wt% based on the gelatin.

Furthermore, Cpd-10 and Cpd-11 were added to each layer to provide a total amount of 25.0 mg/m² and 50 mg/m², respectively.

The spectral sensitizing dyes indicated below were used in the silver chlorobromide emulsion of each photosensitive emulsion layer.

Blue-Sensitive Emulsion Layer: Sensitizing Dye A

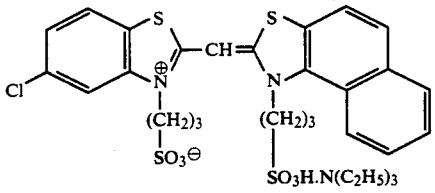

Blue-Sensitive Emulsion Layer: Sensitizing Dye B

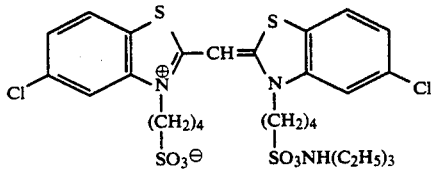

($2.0\times10^{-4}$ mol per mol of silver halide in the large size emulsion A and $2.5\times10^{-4}$ mol per mol of silver halide in the small size emulsion A)

Green-Sensitive Emulsion Layer: Sensitizing Dye C

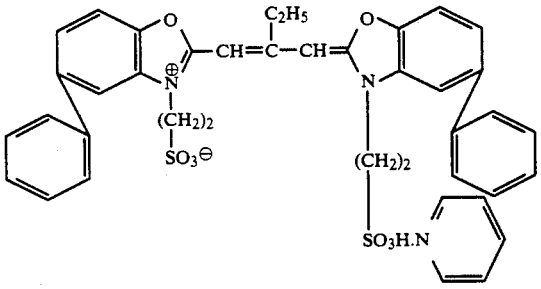

($4.0\times10^{-4}$ mol per mol of silver halide in the large size emulsion B and $5.6\times10^{-4}$ mol per mol of silver halide in the small size emulsion B) and Green-Sensitive Emulsion Layer: Sensitizing Dye D

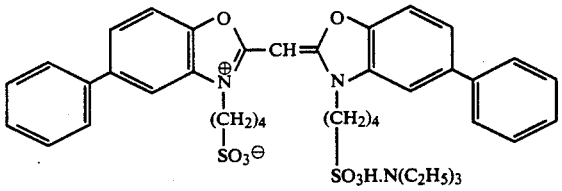

($7.0\times10^{-5}$ mol per mol of silver halide in the large size emulsion B and $1.0\times10^{-5}$ mol per mol of silver halide in the small size emulsion B)

Red-Sensitive Emulsion Layer: Sensitizing Dye E

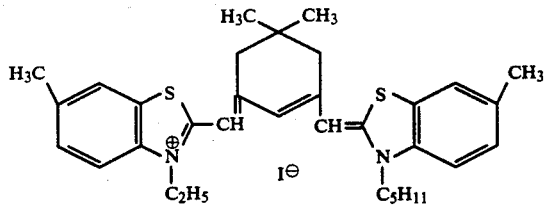

($0.9\times10^{-4}$ mol per mol of silver halide in the large size emulsion C and $1.1\times10^{-4}$ mol per mol of silver halide in the small size emulsion C)

The compound indicated below was added in an amount of $2.6\times10^{-3}$ mol per mol of silver halide to the red-sensitive emulsion layer.

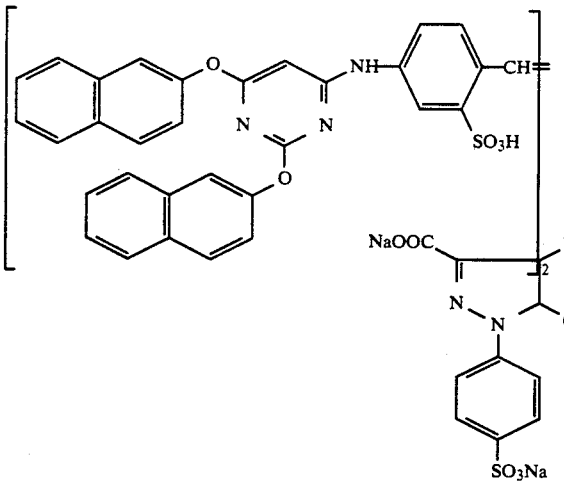

Furthermore, 1-(5-methylureidophenyl)-5-mercaptotetrazole was added to the blue-, green- and red-sensitive emulsions layers in amounts, per mol of silver halide, of $8.5\times10^{-5}$ mol, $7.7\times10^{-4}$ mol and $2.5\times10^{-4}$ mol, respectively.

Furthermore, 4-hydroxy-6-methyl-1,3,3a,7-tetraazaindene was added to the blue- and green-sensitive emulsion layers in amounts, per mol of silver halide, of $1\times10^{-4}$ mol and $2\times10^{-4}$ mol, respectively.

The dyes indicated below (with the coated weights shown in brackets) were added to the emulsion layers for antiirradiation purposes.

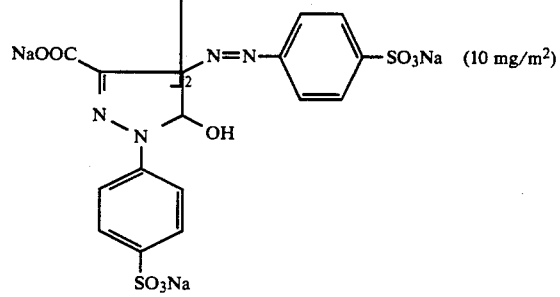

(10 mg/m²)

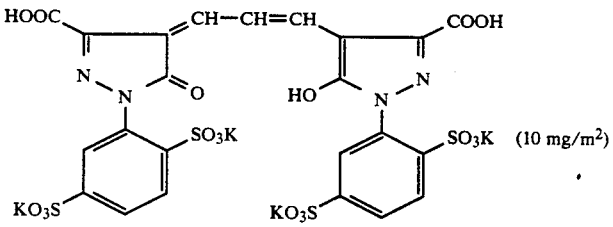

(10 mg/m²)

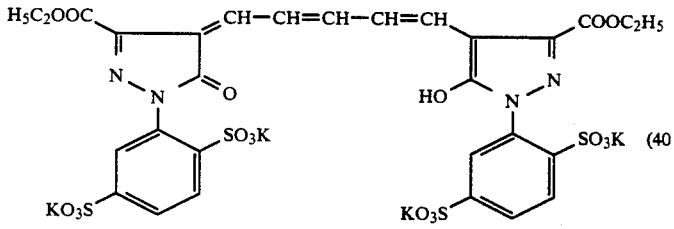

(40 mg/m²) and

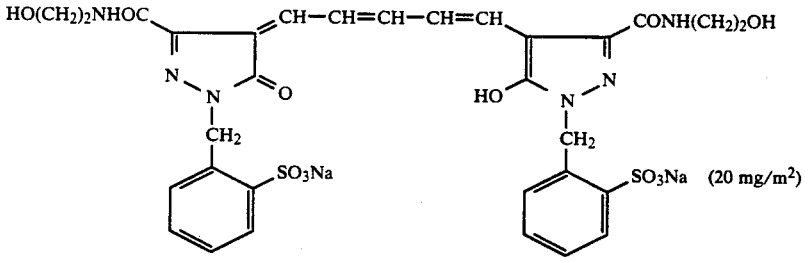

(20 mg/m²)

Layer Structure

The composition of each layer is indicated below. The numerical values indicative coated weights (g/m²). In the case of a silver halide emulsion the coated weight is shown in terms of the coated weight of silver.

Support (Polyethylene Laminated Paper)

Titanium Oxide ($TiO_2$) and a Bluish Dye (ultramarine) Were Included in the Polyethylene on the First Layer Side

| | |
|---|---|
| First Layer (Blue-Sensitive Emulsion Layer) | |
| The Above Described Silver Chlorobromide Emulsion A | 0.30 |
| Gelatin | 0.74 |
| Yellow Coupler (ExY) | 0.82 |

-continued

| | |
|---|---|
| Color Image Stabilizer (Cpd-1) | 0.19 |
| Solvent (Solv-3) | 0.18 |
| Solvent (Solv-7) | 0.18 |
| Color Image Stabilizer (Cpd-7) | 0.06 |
| Second Layer (Anti-Color Mixing Layer) | |
| Gelatin | 0.75 |
| Anti-Color Mixing Agent (Cpd-5) | 0.08 |
| Solvent (Solv-1) | 0.16 |
| Solvent (Solv-4) | 0.08 |
| Third Layer (Green Sensitive Emulsion Layer) | |
| Silver Chlorobromide Emulsion B (a ½ (silver mol ratio) mixture of a large size cubic emulsion B of average grain size 0.55 μm and a small size cubic emulsion B of average grain size 0.39 μm; the variation coefficient of the grain size distributions being 0.10 and 0.08, respectively, and each emulsion having 0.8 mol % AgBr included locally on part of the grain surface) | 0.12 |
| Gelatin | 0.66 |
| Magenta Coupler (ExM) | 0.23 |
| Color Image Stabilizer (Cpd-2) | 0.03 |
| Color Image Stabilizer (Cpd-3) | 0.16 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Absorbing Layer) | |
| Gelatin | 0.61 |
| Ultraviolet Absorber (UV-1) | 0.47 |
| Anti-Color Mixing Agent (Cpd-5) | 0.05 |
| Solvent (Solv-5) | 0.24 |
| Fifth Layer (Red Sensitive Emulsion Layer) | |
| Silver Chlorobromide Emulsion C (a ¼ (silver mol ratio) mixture of a large size cubic emulsion C of average grain size 0.58 μm and a small size cubic emulsion C of average grain size 0.45 μm; the variation coefficient of the grain size distributions being 0.09 and 0.11, respectively, and each emulsion having 0.6 mol % AgBr included locally on part of the grain surfaces) | 0.23 |
| Gelatin | 1.05 |
| Cyan Coupler (ExC) | 0.32 |
| Color Image Stabilizer (Cpd-2) | 0.03 |
| Color Image Stabilizer (Cpd-4) | 0.02 |
| Color Image Stabilizer (Cpd-6) | 0.18 |
| Color Image Stabilizer (Cpd-7) | 0.40 |
| Color Image Stabilizer (Cpd-8) | 0.05 |
| Solvent (Solv-6) | 0.14 |
| Sixth Layer (Ultraviolet Absorbing Layer) | |
| Gelatin | 1.05 |
| Ultraviolet Absorber (UV-1) | 0.16 |
| Anti-Color Mixing Agent (Cpd-5) | 0.02 |
| Solvent (Solv-5) | 0.08 |
| Seventh Layer (Protective Layer) | |
| Gelatin | 0.63 |
| Acrylic Modified Poly(vinyl alcohol) Copolymer (17% modification) | 0.17 |
| Liquid Paraffin | 0.03 |

(ExY) Yellow Coupler

A 1/1 (mol ratio) mixture of

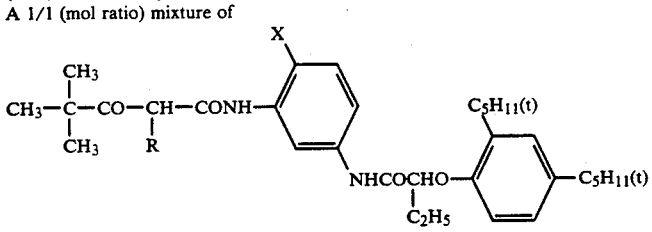

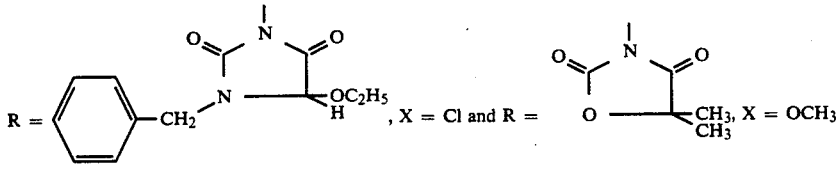

(ExM) Magenta Coupler

-continued
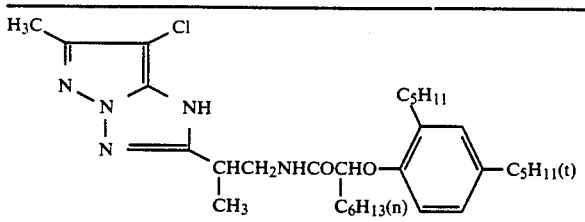
(ExC) Cyan Coupler
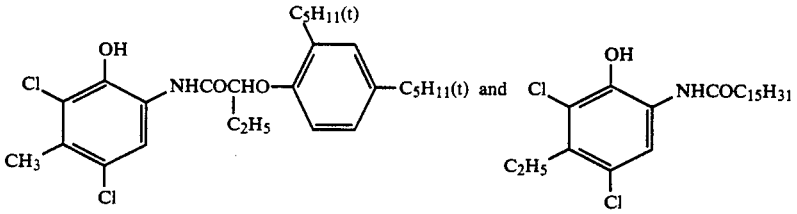
(Cpd-1) Color Image Stabilizer
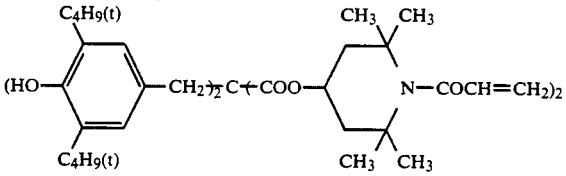
(Cpd-2) Color Image Stabilizer
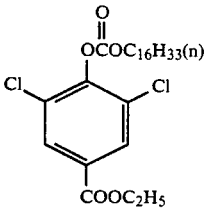
(Cpd-3) Color Image Stabilizer
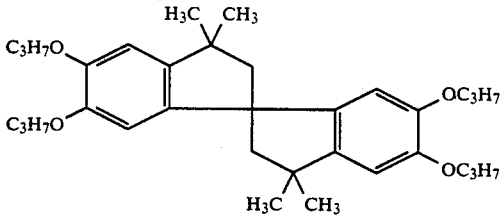
(Cpd-4) Color Image Stabilizer
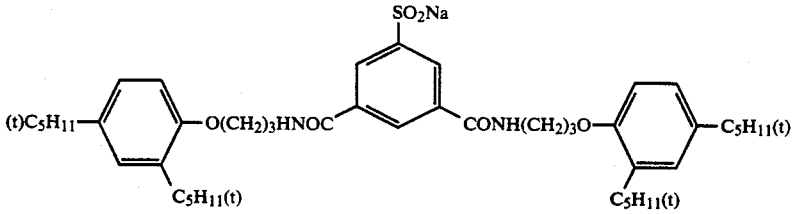
(Cpd-5) Anti-Color-Mixing Agent
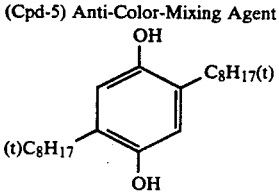
(Cpd-6) Color Image Stabilizer
A 2/4/4 (by weight) mixture of:

-continued
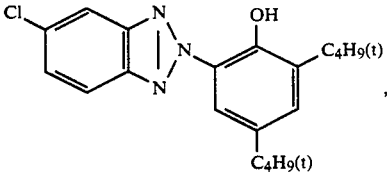
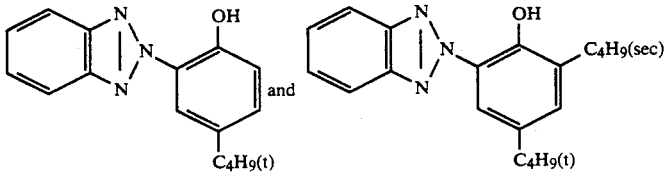
(Cpd-7) Color Image Stabilizer
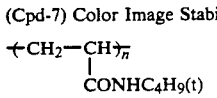
(average molecular weight: 60,000)
(Cpd-8) Color Image Stabilizer
A 1/1 (by weight) mixture of:
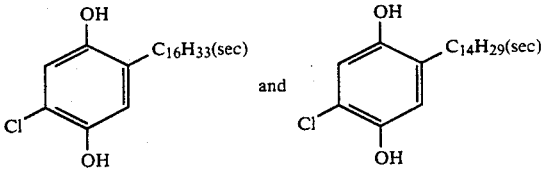
(Cpd-9) Color Image Stabilizer
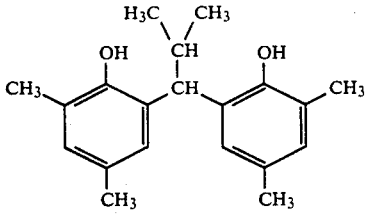
(Cpd-10) Fungicide
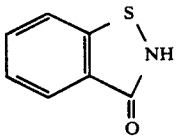
(Cpd-11) Fungicide
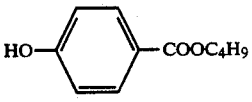
(UV-1) Ultraviolet Absorbing Agent
A 4/2/4 (by weight) mixture of:
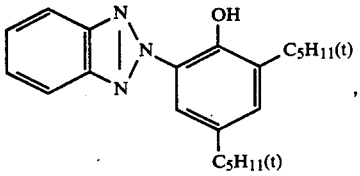

-continued

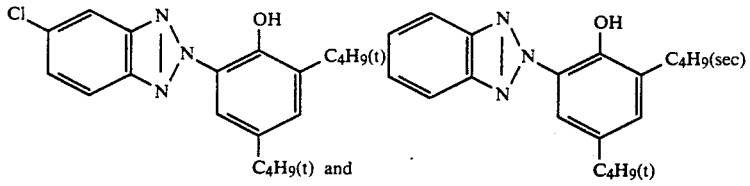

(Solv-1) Solvent

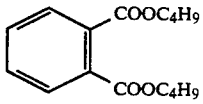

(Solv-2) Solvent
A 1/1 (by volume) mixture of:

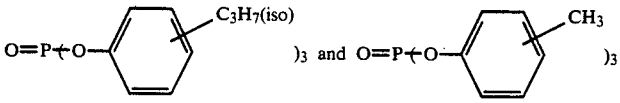

(Solv-3) Solvent
$O{=}P{\leftarrow}O{-}C_9H_{19}(iso))_3$ (Solv-4) Solvent

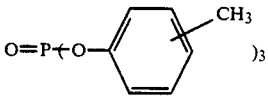

(Solv-5) Solvent
$COOC_8H_{17}$
|
$(CH_2)_8$
|
$COOC_8H_{17}$ (Solv-6) Solvent
An 80/20 (by volume) mixture of:

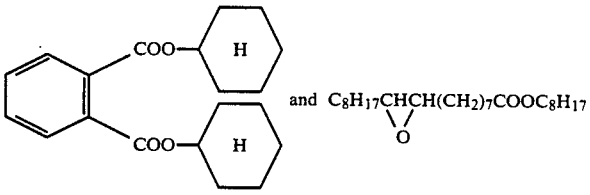

(Solv-7) Solvent
$C_8H_{17}CHCH(CH_2)_7COOC_8H_{17}$
$\backslash\ /$
O

The sample formed in this way was called Sample 101. The alkali consumption of this sample was 2.3 mol/m$^2$.

The sample was subjected to a graded exposure with tricolor separation filters for sensitometric purposes using a sensitometer (model FWH, made by the Fuji Photo Film Co., Ltd., light source color temperature 3,200° K.). The exposure was 250 CMS with an exposure time of 0.1 second.

The exposed sample was continuously processed in a paper processor (in a running test) using the processing operations indicated below until the system had been replenished to the extent of twice the color development tank capacity.

| Process | Temperature (°C.) | Time (sec) | Replenishment Rate* (ml) | Tank Capacity (liter) |
|---|---|---|---|---|
| Color Development | 40 | 20 | 80 | 4 |
| Bleach-Fixing | 40 | 20 | 60 | 3 |
| Rinsing (1) | 45 | 10 | — | 2 |
| Rinsing (2) | 45 | 10 | — | 2 |
| Rinsing (3) | 45 | 10 | — | 2 |
| Rinsing (4) | 45 | 10 | 90 | 2 |
| Drying | 70–80 | 10 | — | 2 |

*Replenishment rate per square meter of photosensitive material.

Furthermore, jet agitation in which a jet of water was directed perpendicularly onto the sample surface was used in each tank, and a four tank countercurrent system from rinsing (4) to rinsing (1) was used. Furthermore, the amount of water carry-over of the sensitive material from the water washing tank was 35 ml/m$^2$.

The composition of each processing solution was as indicated below.

| | Tank Solution | Replenisher |
|---|---|---|
| Color Developer: | | |
| Water | 800 ml | 800 ml |
| 1-Hydroxyethylidene-1,1-diphosphonic Acid | 0.5 g | 0.7 g |
| Diethylenetriaminepentaacetic Acid | 1.0 g | 1.4 g |
| N,N,N-Trismethylenephosphonic Acid | 1.5 g | 2.0 g |
| Potassium Bromide | 0.01 g | — |
| Triethanolamine | 8.1 g | 8.1 g |
| Sodium Sulfite | 0.14 g | 0.14 g |
| Potassium Chloride | 8.2 g | — |
| Potassium Carbonate | 18.7 g | 37 g |
| N-Ethyl-N-(3-hydroxypropyl)-3-methyl-4-aminoaniline Di-p-toluenesulfonate | 12.8 g | 27.8 g |
| N,N-Bis(2-sulfoethyl)-hydroxylamine | 8.5 g | 11.0 g |
| Fluorescent Brightening Agent (WHITEX 4B, manufactured by Sumitomo Chemicals) | 1.0 g | 1.0 g |
| Water to make | 1,000 ml | 1,000 ml |
| pH (25° C.) | 10.05 | 10.95 |
| Bleach-Fixing Solution | | |
| Water | 400 ml | 400 ml |
| Ammonium Thiosulfate (70 wt %) | 100 ml | 250 ml |
| Ammonium Sulfite | 40 g | 100 g |
| Ethylenediaminetetraacetic Acid Iron (III) Ammonium Salt Dihydrate | 73 g | 183 g |
| Ethylenediaminetetraacetic Acid | 3.4 g | 8.5 g |
| Ammonium Bromide | 20 g | 50 g |
| Nitric Acid (67 wt %) | 9.6 g | 24 g |
| Water to make | 1,000 ml | 1,000 ml |
| pH (25° C.) | 5.80 | 5.10 |

Rinsing solution (Tank Solution=Replenisher)

Ion exchanger water (calcium and magnesium content both less than 3 ppm.

A reverse osmosis membrane was provided by using a spiral type RO module element DRA-80 (effective membrane area 1.1 $m^2$, polysulfone based composite membrane) manufactured by the Daisel Chemical Co. and this membrane was arranged in a plastic pressure resistant vessel PV-0321 manufactured by the same company.

Water from the third rinsing tank was fed under pressure to the reverse osmosis membrane using a pump under conditions of a liquid feed pressure of 5 $kg/cm^2$, a liquid feed rate of 1.8 liters/min. The water permeated through the membrane was supplied to the fourth rinsing tank, and the concentrated water was returned to the third rinsing tank. This is referred to hereinafter as processing operation (I).

After color development processing, the yellow, magenta and cyan densities were measured using a densitometer to obtain their characteristic curves.

Moreover, the photosensitive material processed at the beginning and the end of the continuous processing run was stored for 14 days under conditions of 80° C., 70% RH and the fractional increase on storage of the minimum blue density portion was determined as an evaluation of staining.

Processing operations (II) to (VI) were established by modifying parts of the above described processing operation (I) as indicated below.

| Processing Operation | Bleaching Agent Concentration (mol/l) | P-1 (sec) | P-2 (sec) | W (sec × No. of tanks) | Dry (sec) | Total (sec) | RO Treatment |
|---|---|---|---|---|---|---|---|
| I (Invention) | 0.175 | 20 | 20 | 10 × 4 | 15 | 95 | Yes |
| II (Invention) | 0.254 | 20 | 20 | 10 × 4 | 15 | 95 | Yes |
| III (Invention) | 0.175 | 30 | 20 | 8 × 4 | 15 | 97 | Yes |
| IV (Invention) | 0.175 | 20 | 13 | 13 × 4 | 15 | 100 | Yes |
| V (Comparison) | 0.126 | 20 | 20 | 10 × 4 | 15 | 95 | Yes |
| VI (Comparison) | 0.254 | 20 | 20 | 10 × 4 | 15 | 95 | No |

In this table:
P-1 is the color development time,
P-2 is the bleach-fixing time,
W is the water washing and/or stabilizing time,
Dry is the drying time, and
RO means reverse osmosis membrane.

The equilibrium iron concentrations in the final bath and the bath preceding the final bath after continuous processing were as indicated below.

| Final Process | Iron Concentration of Preceding Bath (ppm) | Iron Concentration of Final Bath (ppm) | Concentration Ratio |
|---|---|---|---|
| I (Invention) | 350 | 10 | 35 |
| II (Invention) | 490 | 13 | 39 |
| III (Invention) | 350 | 10 | 35 |
| IV (Invention) | 350 | 11 | 32 |
| V (Comparison) | 252 | 9 | 28 |
| VI (Comparison) | 490 | 132 | 3.8 |

The processed sample obtained at the end of continuous processing had satisfactory image formation with all of the processing operations and all were suitable for rapid processing, but the sample obtained using processing operation (V) had some yellow turbidity due to desilvering failure. The results for staining upon storage are shown in the table below.

| Processing Operation | Blue Minimum Density after Storage: Start of Continuous Processing | Blue Minimum Density after Storage: End of Continuous Processing |
|---|---|---|
| I (Invention) | 0.12 | 0.13 |
| II (Invention) | 0.12 | 0.13 |
| III (Invention) | 0.12 | 0.14 |
| IV (Invention) | 0.12 | 0.13 |
| V (Comparison) | 0.12 | 0.13 |
| VI (Comparison) | 0.13 | 0.24 |

As indicated above, in a rapid processing system where the bleaching agent concentration is relatively low, the extent of color turbidity is increased as a result of desilvering failure (e.g., Comparison V). If the bleaching agent concentration is increased in order to overcome this problem, then increased staining inevitably occurs (e.g., Comparison VI). On the other hand, it is clearly seen that rapid processing can be carried out with good desilvering and staining aspects using a high bleaching agent concentration if the iron concentration ratio in the preceding tank with respect to the final tank is set to a value of at least seven using, e.g., a reverse osmosis membrane treatment.

Moreover, with a color development time of at least 20 seconds or a water washing time of at least 45 seconds, a burden is imposed on the other processes, and some deterioration with respect to staining and color turbidity tends to occur.

EXAMPLE 2

Processing operations (2-I) to (5-I) were devised by modifying parts of processing operation (I) of Example 1 as indicated below, and Sample 101 was then processed in the same way as described in Example 1.

| Processing Operation | Part Modified | Modification |
|---|---|---|
| 2-I | Washing time: 10 sec × three tanks | Replenishment rate: 120 ml/m$^2$ |
| 3-I | Replenishment rate: 120 ml/m$^2$ | |
| 4-I | Carry-over of processing solution by photo-sensitive material | 75 ml/m$^2$ |
| 5-I | Reverse osmosis membrane type | DRA-40 |

The results obtained on measuring the equilibrium iron concentrations in the final water washing tank and the preceding water washing tank after continuous processing were as shown in the table below.

| Final Process | Iron Concentration of Preceding Bath (ppm) | Iron Concentration of Final Bath (ppm) | Concentration Ratio |
|---|---|---|---|
| 2-I | 470 | 15 | 31 |
| 3-I | 120 | 8 | 15 |
| 4-I | 350 | 18 | 19 |
| 5-I | 330 | 16 | 20 |

Staining tests were carried out under the same conditions as in Example 1 after using processing operations (2-I) to (5-I). In all cases virtually no staining was observed and the present invention clearly had a pronounced effect.

EXAMPLE 3

The layer composition alone indicated below of Sample 101 of Example 1 was modified to provide Sample 20A, and this sample processed using the same Processing Operation (I) as in Example 1.

| Sample No. | Basic Formulation | Layer | Modification |
|---|---|---|---|
| 20A | 101 | First Layer | Gelatin: 1.06 |
| | | Second Layer | Gelatin: 1.19 |
| | | Third Layer | Gelatin: 1.24 |
| | | Fourth Layer | Gelatin: 1.37 |

The alkali consumption of Sample 20A was 3.1 mmol/m$^2$. On development for 20 seconds in Processing Operation (I), the density was low and a satisfactory image was not obtained.

EXAMPLE 4

The 4-amino-N-ethyl-N-(3-hydroxypropyl)-3-methylaniline di-p-toluenesulfonate (D-6) in the color developer of Processing Operation (I) of Example 1 was replaced by the compounds indicated below (an equimolar amount in each case, and the salt was that of di-p-toluenesulfonic acid), and otherwise processing was carried out in the same manner as in Example 1.

| Process No. | Modified Compound |
|---|---|
| 4-1 | Compound D-5 of this specification |
| 4-2 | Compound D-7 of this specification |
| 4-3 | Compound D-12 of this specification |

Suitability for rapid processing, color turbidity and staining were all satisfactory on processing with the processing operations in which the developing agent had been replaced by Compounds 4-1 to 4-3.

The present invention provides satisfactory photographic performance even when carrying out ultra-rapid processing with a shortened processing time from the desilvering process to the water washing process and a shortened total processing time from color development to drying. The present invention is especially effective for preventing the occurrence of staining.

The effect is achieved satisfactorily even when the replenishment rate of the water washing water and/or stabilizer is low.

Moreover, by treating with a reverse osmosis membrane at a pressure of not more than 10 kg/cm$^2$, the size of the apparatus and noise level may be reduced, and the present invention is suitable for application to processing intelligent hard copy (e.g., a photosensitive material exposed to scanning laser exposure).

While the invention has been described in detail and with reference to specific embodiments thereof, it will be apparent to one skilled in the art that various changes and modifications can be made therein without departing from the spirit and scope thereof.

What is claimed is:

1. A method for continuously processing an imagewise exposed silver halide color photographic material comprising a support having thereon at least one silver halide emulsion layer, comprising the steps of developing with a color developer, bleaching with a processing bath having a bleaching ability comprising a bleaching agent in a concentration of at least 0.15 mol/liter, water washing and/or stabilizing with at least two sequential processing tanks, and drying the thus processed photographic material, wherein the equilibrium iron concentration of the processing solution in the tank immediately preceding the final tank of the water washing and/or stabilizing step is from 100 to 500 ppm and the equilibrium iron concentration is at least seven times that of the processing solution in the final tank of the water washing and/or stabilizing step, and the time from the start of the bleaching step to the completion of the water washing and/or stabilizing step is not more than 65 seconds.

2. A method as in claim 1, wherein said processing bath having a bleaching ability is at least one of a bleaching process and a bleach-fixing process.

3. A method as in claim 1, wherein said processing bath having a bleaching ability contains a bleaching agent in an amount of from 0.16 to 0 27 mol/liter.

4. A method as in claim 1, wherein said processing bath having a bleaching ability contains at least one organic complex salt of iron(III) selected from the group consisting of ethylenediaminetetraacetic acid, diethylenetriaminepentaacetic acid, cyclohexanediamine-tetraacetic acid, 1,3-diaminopropanetetraacetic acid and methyliminodiacetic acid.

5. A method as in claim 1, wherein the equilibrium iron concentration of the processing solution in the tank immediately preceding the final tank of the water washing and/or stabilizing step is from 100 to 300 ppm.

6. A method as in claim 1, wherein the equilibrium iron concentration of the processing solution in the tank immediately preceding the final tank of the water washing and/or stabilizing step is at least 9 times that of the processing solution in the final tank of the water washing and/or stabilizing step.

7. A method as in claim 1, wherein the time from the start of the bleaching step to the completion of the water washing and/or stabilizing step is not more than 55 seconds.

8. A method as in claim 1, wherein said at least one silver halide emulsion layer comprises a silver halide emulsion containing at least 90 mol% of silver chloride, the alkali consumption of the photographic material is not more than 3.0 mmol/$m^2$, and the time from the start of the developing step to the completion of the drying step is not more than 100 seconds.

9. A method as in claim 8, wherein the time from the start of the developing step to the completion of the drying step is not more than 90 seconds.

10. A method as in claim 8, wherein the alkali consumption of the photographic material is not more than 2.8 mmol/$m^2$.

11. A method as in claim 8, wherein the alkali consumption of the photographic material is not more than 1.9 mmol/$m^2$.

12. A method as in claim 1, wherein the color developer has a sulfite ion concentration of not more than $3.0\times10^{-3}$ mol/liter.

13. A method as in claim 1, wherein the color developer has a hydroxylamine concentration of not more than $5.0\times10^{-3}$ mol/liter.

14. A method as in claim 1, wherein the processing time for the developing step is not more than 20 seconds.

15. A method as in claim 1, wherein the processing time for the bleach-fixing or fixing step is from 10 to 60 seconds.

16. A method as in claim 1, wherein the processing time for the water washing and/or stabilizing step is from 10 to 45 seconds.

17. A method as in claim 10, wherein the processing time for the drying step is from 10 to 40 seconds.

* * * * *